US008087099B2

(12) United States Patent
Sawabe

(10) Patent No.: US 8,087,099 B2
(45) Date of Patent: Jan. 3, 2012

(54) HELMET AND HELMET SIZE ADJUSTING METHOD

(75) Inventor: Akira Sawabe, Toride (JP)

(73) Assignee: Shoei Co., Ltd., Tokyo (JP)

( * ) Notice: Subject to any disclaimer, the term of this patent is extended or adjusted under 35 U.S.C. 154(b) by 1032 days.

(21) Appl. No.: 11/970,000

(22) Filed: Jan. 7, 2008

(65) Prior Publication Data

US 2008/0184463 A1 Aug. 7, 2008

(30) Foreign Application Priority Data

Feb. 6, 2007 (JP) ..... 2007-26579

(51) Int. Cl.
*A42B 3/10* (2006.01)

(52) U.S. Cl. ..... 2/420; 2/411; 2/414; 2/417

(58) Field of Classification Search ..... 2/455, 410, 2/411, 412, 414, 417, 418, 419, 420, 425
See application file for complete search history.

(56) References Cited

U.S. PATENT DOCUMENTS

| | | | | |
|---|---|---|---|---|
| 3,127,615 | A | 4/1964 | Aileo | |
| 3,289,212 | A * | 12/1966 | Morgan | 2/420 |
| 3,820,163 | A * | 6/1974 | Rappleyea | 2/420 |
| 3,849,801 | A * | 11/1974 | Holt et al. | 2/413 |
| 4,287,613 | A * | 9/1981 | Schulz | 2/413 |
| 4,290,150 | A | 9/1981 | Guerre-Berthelot | |
| 4,404,690 | A * | 9/1983 | Farquharson | 2/420 |
| 4,598,430 | A | 7/1986 | Nava | |
| 4,796,309 | A | 1/1989 | Nava | |
| 4,916,759 | A * | 4/1990 | Arai | 2/414 |
| 5,012,533 | A * | 5/1991 | Raffler | 2/420 |
| 5,088,129 | A | 2/1992 | Kamata | |
| 5,272,773 | A * | 12/1993 | Kamata | 2/421 |
| 5,815,847 | A | 10/1998 | Holden, Jr. | |
| 5,953,761 | A | 9/1999 | Jurga et al. | |
| 6,159,324 | A * | 12/2000 | Watters et al. | 156/242 |
| 6,185,753 | B1 | 2/2001 | Arai | |
| 6,202,223 | B1 | 3/2001 | Chartrand | |

(Continued)

FOREIGN PATENT DOCUMENTS

EP 0 797 935 A1 10/1997

(Continued)

*Primary Examiner* — Christopher Harmon
(74) *Attorney, Agent, or Firm* — Smith Gambrell & Russell LLP

(57) ABSTRACT

A cap-like head backing cover includes a plurality of types of cover components. The plurality of types of cover components include cover main body portions, and connecting means capable of separably connecting and combining the cover main body portions of one of the cover components to and with the cover main body portions of another at least one of the cover components. The cover main body portions of the plurality of types of cover components are connected to and combined with each other by the connecting means, to form the cap-like head backing cover which includes the plurality of types of cover components and is independent. With the helmet having this arrangement, even when a helmet wearer whose head shape is different from that of an average human head is to wear the helmet, the helmet can be matched to the head of the helmet wearer substantially optimally. The helmet size can be not only partially decreased but also partially increased. The cover component at an arbitrary portion of the cap-like head backing cover can be exchanged with a comparatively simple operation. Also, head backing cover can be attached to an impact-on-the-head absorbing liner or the like comparatively easily.

22 Claims, 14 Drawing Sheets

U.S. PATENT DOCUMENTS

| | | | | |
|---|---|---|---|---|
| 6,253,386 | B1 | 7/2001 | Gafforio | |
| 6,256,797 | B1 | 7/2001 | Nemoto et al. | |
| 6,279,172 | B1 * | 8/2001 | Epperson et al. | 2/410 |
| 6,292,953 | B1 * | 9/2001 | Beautz | 2/422 |
| 6,308,343 | B1 | 10/2001 | Arai | |
| 6,499,147 | B2 | 12/2002 | Schiebl et al. | |
| 6,557,184 | B2 | 5/2003 | Gafforio | |
| 6,961,963 | B2 * | 11/2005 | Rosie | 2/171.3 |
| 7,159,249 | B2 * | 1/2007 | Dennis et al. | 2/421 |
| 7,207,071 | B2 | 4/2007 | Pierce | |
| 7,316,036 | B2 * | 1/2008 | Rudolf et al. | 2/414 |
| 7,426,761 | B2 | 9/2008 | Tomcany et al. | |
| 7,765,621 | B2 * | 8/2010 | Lardeau | 2/414 |
| 7,854,023 | B2 | 12/2010 | Ando | |
| 2001/0034895 | A1 | 11/2001 | Ikeda | |
| 2002/0007508 | A1 * | 1/2002 | Grepper et al. | 2/420 |
| 2002/0035748 | A1 * | 3/2002 | Racine | 2/414 |
| 2002/0189005 | A1 | 12/2002 | Taniuchi | |
| 2003/0051289 | A1 | 3/2003 | Gafforio et al. | |
| 2003/0074722 | A1 | 4/2003 | Lee | |
| 2003/0088907 | A1 | 5/2003 | Gafforio et al. | |
| 2003/0182716 | A1 | 10/2003 | Wu | |
| 2003/0196255 | A1 | 10/2003 | Arai | |
| 2004/0034903 | A1 | 2/2004 | Blair | |
| 2006/0117467 | A1 | 6/2006 | Choi et al. | |
| 2006/0195973 | A1 | 9/2006 | Ikeda | |
| 2007/0163031 | A1 * | 7/2007 | Lewis et al. | 2/414 |
| 2008/0289085 | A1 | 11/2008 | Bryant et al. | |
| 2009/0031483 | A1 | 2/2009 | Wallerberger | |
| 2009/0158506 | A1 | 6/2009 | Thompson et al. | |
| 2009/0260135 | A1 | 10/2009 | Haselmayer | |
| 2010/0095438 | A1 | 4/2010 | Moelker | |

FOREIGN PATENT DOCUMENTS

| | | | |
|---|---|---|---|
| EP | 0 879 566 | A2 | 11/1998 |
| EP | 1 293 138 | A1 | 3/2003 |
| EP | 1 854 368 | A2 | 11/2007 |
| JP | 62-69812 | | 3/1987 |
| JP | 09-11014 | | 5/1997 |
| JP | 11-247018 | | 9/1999 |
| JP | 2000-160424 | | 6/2000 |
| JP | 2001-115327 | | 4/2001 |
| JP | 2002-138320 | | 5/2002 |
| JP | 2005-54300 | A | 3/2005 |

* cited by examiner

HELMET AND HELMET SIZE ADJUSTING METHOD

TECHNICAL FIELD

The present invention relates to a helmet in which a cap-like head backing cover is mounted inside the helmet and comprises a plurality of types of cover components respectively comprising cover main body portions. The present invention also relates to a method of adjusting the size of a helmet in which a cap-like head backing cover is mounted inside the helmet and comprises a plurality of types of cover components respectively comprising cover main body portions.

BACKGROUND OF THE INVENTION

Helmet sizes are generally known to include four types, i.e., S size (55 cm to 56 cm), M size (57 cm to 58 cm), L size (59 cm to 60 cm) and XL size (61 cm or more). Each of the above values indicates the circumferential length of the head of a helmet wearer. In helmets of the four types of sizes, portions corresponding to the head circumferential lengths of the head accommodating spaces are substantially similar ellipses.

When a helmet shop selling helmets is to sell a helmet to a prospective helmet purchaser such as a prospective helmet wearer who is to wear a helmet, in one case, the shop sells a helmet of the size that the prospective helmet purchaser indicates. In another case, the employee of the helmet shop measures the circumferential length of the head of the prospective helmet wearer with a tape measure or the like. The employee selects the type of the matched size from the matched sizes indicated on the tape measure or the like, and sells a helmet of the selected type to the prospective helmet purchaser.

There has been conventionally known use of a personal computer using software (i.e., a computer program) for elliptic shape calculation in the helmet shop. In this case, the employee of the helmet shop measures the back-and-forth length and left-and-right width of the head of the prospective helmet wearer using a measure such as a head size measuring tool, a rule, or the like. The circumferential length of the head is calculated from the measurement values using the personal computer. The type of the recommendable helmet size is selected on the basis of the calculated value from the sizes attached to the helmets of the respective types of sizes.

The above conventional method, however, has the following drawbacks. More specifically, both measurement of the circumferential length of the head using the tape measure and calculation of the circumferential length of the head using the elliptic shape calculation program are based on the assumption that the head of the prospective helmet wearer has a specific elliptic shape substantially similar to the elliptic shape of an average human head. Hence, the ratio of the major axis to the minor axis of the specific elliptic shape is substantially constant regardless of the type of the helmet size.

The perimetric shape of the head of the prospective helmet wearer differs from one person to another even if the circumferential length is the same, and does not always substantially coincide with the specific elliptic shape. Therefore, when selecting the type of the helmet size on the basis of only the circumferential length of the head of the prospective helmet wearer, the helmet having the size of the selected type may not fit (that is, match) the head of the prospective helmet wearer. In this case, the prospective helmet wearer must wear a helmet having a size larger than necessary.

For example, according to Japanese Patent Laid-Open No. 2000-160424, to eliminate the drawbacks in the conventional method as described above, a pocket is formed in the neck pad, and a plate-like adjusting pad is inserted in the pocket, thereby adjusting the size of the helmet. In this case, although the size of the helmet can be decreased, it cannot be increased. As the plate-like adjusting pad is inserted in the pocket, not only the operation of inserting and removing the adjusting pad into and from the pocket is cumbersome, but also the inner surface of the helmet becomes coarse. This makes the helmet wearer feel uneasy when wearing the helmet, giving an uncomfortable set. To eliminate this coarseness, the outer portion of the adjusting pad may be tapered to be gradually thin toward the outer side. In this case, however, the operation of inserting and removing the adjusting pad into and from the pocket becomes more cumbersome, and the adjusting pad tends to be damaged and broken easily.

SUMMARY OF THE INVENTION

The present invention is aimed at correcting the defects of the above conventional method and the method disclosed in Japanese Patent Laid-Open No. 2000-160424 effectively with a comparatively simple arrangement.

According to the first aspect of the present invention, there is provided a helmet comprising a cap-like head backing cover mounted inside said helmet, the cap-like head backing cover comprising a plurality of types of cover components respectively comprising cover main body portions, wherein the plurality of types of cover components respectively comprise connecting means capable of separably connecting and combining the cover main body portion of one of the cover components to and with the cover main body portion of another at least one of the cover components, the plurality of types of cover main body portions are connected to and combined with each other by the connecting means, to form the cap-like head backing cover which comprises the plurality of types of cover components and is independent, and the cover main body portions connected to each other by the connecting means are disconnected and separated from each other, to separate the cap-like head backing cover into the plurality of types of cover components that are independent of each other.

According to the second aspect of the present invention, there is provided a method of adjusting a size of a helmet comprising a cap-like head backing cover mounted inside the helmet, the cap-like head backing cover comprising a plurality of types of cover components respectively comprising cover main body portions, wherein the method comprises forming the plurality of types of cover components respectively to comprise in advance connecting means capable of separably connecting and combining the cover main body portion of one of the cover components to and with the cover main body portion of another one of the cover components, connecting and combining the plurality of types of cover main body portions to and with each other by the connecting means, to obtain the cap-like head backing cover which comprises the plurality of types of cover components and is independent, disconnecting and separating the cover main body portions, connected to each other by the connecting means, from each other, to separate the cap-like head backing cover into the plurality of types of cover components that are independent of each other, preparing at least one type of another cover component having at least different thickness in advance for at least one type of cover component among the plurality of types of cover components, and exchanging at least one type of cover component among the plurality of types of cover components for another cover component prepared in advance, so that a head accommodating space of the helmet has a different size at least at one portion.

In the first and second aspects of the present invention described above, according to their first mode, one cover component among the plurality of types of cover components is located substantially at a region (e.g., a fore-head region or occiput region) including at least a partial region of a region comprising a fore-head region and an occiput region of the head backing cover substantially opposing a fore-head part and an occiput part, respectively, of a head of a helmet wearer. In the first and second aspects of the present invention described above, according to their second mode, one cover component among the plurality of types of cover components is located substantially at a region (e.g., a left temple region or a right temple region) including at least a partial region of a region comprising a left temple region and a right temple region of the head backing cover substantially opposing a left temple part and a right temple part, respectively, of a head of a helmet wearer. In the first and second aspects of the present invention described above, according to their third mode, one cover component among the plurality of types of cover components is located substantially at a region (e.g., a vertex region) including at least a partial region of a vertex region of the head backing cover substantially opposing a vertex part of a head of a helmet wearer.

In the first and second aspects of the present invention described above, according to their fourth mode, the head backing cover comprises a fore-head part cover component, a vertex part cover component, a left temple part cover component, a right temple part cover component and an occiput part cover component respectively located substantially at a fore-head region, a vertex region, a left temple region, a right temple region and an occiput region of the head backing cover substantially opposing a fore-head part, a vertex part, a left temple part, a right temple part and an occiput part, respectively, of a head of a helmet wearer. In the first and second aspects of the present invention described above, according to their fifth mode, the plurality of types of cover components include an upper occiput part cover component and a lower occiput part cover component located substantially at an upper portion and a lower portion, respectively, of an occiput region of the head backing cover substantially opposing an upper occiput part portion and a lower occiput part portion, respectively, of a head of a helmet wearer. In the first and second aspects of the present invention described above, according to their sixth mode, the upper occiput part cover component and the lower occiput part cover component constitute a composite-type occiput part cover component located substantially at an occiput region substantially opposing an occiput part of a head of a helmet wearer.

In the first and second aspects of the present invention described above, according to their seventh mode, the connecting means provided to the plurality of types of cover components includes a slit-like hole for target insertion engagement provided to one cover component and an insertion engaging portion provided to the other cover component which is to be connected to the one cover component, the insertion engaging portion being formed to be removably inserted in the slit-like opening. In this case, the slit-like opening preferably comprises a pair of slit-like openings which substantially oppose each other, and the insertion engaging portion preferably comprises a pair of inserting portions substantially corresponding to the pair of slit-like openings, respectively. In the first and second aspects of the present invention described above, according to their eighth mode, the connecting means provided to the plurality of types of cover components includes a first Hook-and-Loop fastener component provided to one cover component and a second Hook-and-Loop fastener component provided to the other cover component which is to be connected to the one cover component, and the first Hook-and-Loop fastener component and the second Hook-and-Loop fastener component are detachably connected to each other. In the first and second aspects of the present invention, according to their ninth mode, the connecting means provided to the plurality of types of cover components includes a male hook provided to one cover component and a female hook provided to the other cover component which is to be connected to the one cover component, and the male hook being formed to be detachably fitted with the female hook.

In the first and second aspects of the present invention described above, according to their 10th mode, a cover main body portion of at least one type of cover component among the plurality of cover components includes an elastic layer made of a foamed synthetic resin. In the first and second aspects of the present invention described above, according to their 11th mode, the plurality of types of cover components comprise at least three types of cover components. In this case, in the second aspect of the present invention described above, at least one type of another cover component having at least a different thickness is preferably prepared in advance for at least two types of cover components among the at least three types of cover components. In the first and second aspects of the present invention described above, according to their 12th mode, each one of cover main body portions of at least two types of cover components among the at least three types of cover components includes an elastic layer made of a foamed synthetic resin. In the first and second aspects of the present invention described above, according to their 13th aspect, the plurality of types of cover components comprise at least five types of cover components. In this case, in the second aspect of the present invention described above, at least one type of another cover component having a different thickness is preferably prepared in advance for at least three types of cover components among the at least five types of cover components. In the first and second aspects of the present invention described above, according to the 13th mode, each one of cover main body portions of at least three types of cover components among the at least five types of cover components preferably includes an elastic layer made of a foamed synthetic resin. Furthermore, in the first and second aspects of the present invention described above, according to their 14th aspect, each one of cover main body portions of the plurality of cover components includes an elastic layer made of a foamed synthetic resin.

According to the present invention described above, at least one type of cover component itself at a predetermined portion among the plurality of types of cover components that form the cap-like head backing cover can be exchanged as a whole. Therefore, the larger the number of types of exchangeable cover components (in other words, the number of types of exchangeable portions) among the cover components that constitute the cap-like head backing cover, even when a helmet wearer whose head shape is different from that of an average human head is to wear a helmet, the helmet can be matched to the head of the helmet wearer substantially optimally. The thickness of the cap-like head backing cover can be not only partially increased but also partially decreased. Thus, the helmet size can be not only partially decreased but also partially increased. Furthermore, the prospective helmet wearer himself can exchange the cover component at a predetermined portion for the purpose of size adjustment or repair of a broken portion without using a special tool and with a comparatively simple operation. Even though the cap-like head backing cover comprises a plurality of types of cover components, the head backing cover formed by combining the plurality of types of cover components can be treated in the same manner as a single component. Therefore, the head backing cover can be attached to a cap-like impact-on-the-head absorbing liner or the like comparatively easily.

The above, and other, objects, features and advantages of the present invention will become readily apparent from the following detailed description thereof which is to be read in connection with the accompanying drawings.

DETAILED DESCRIPTION OF THE INVENTION

The first to third embodiments in which the present invention is applied to a full-face-type helmet will be described in "A. First Embodiment", "B. Second Embodiment" and "C. Third Embodiment" with reference to the accompanying drawings.

A. First Embodiment

The first embodiment of the present invention will be described in "1. Schematic Arrangement of Helmet as a Whole", "2. Practical Arrangement of Cap-Like Head Backing Cover", "3. How to Assemble Cover Components" and "4. How to Adjust Helmet Size" with reference to FIGS. 1 to 15.

1. Schematic Arrangement of Helmet as a Whole

Figure 1:
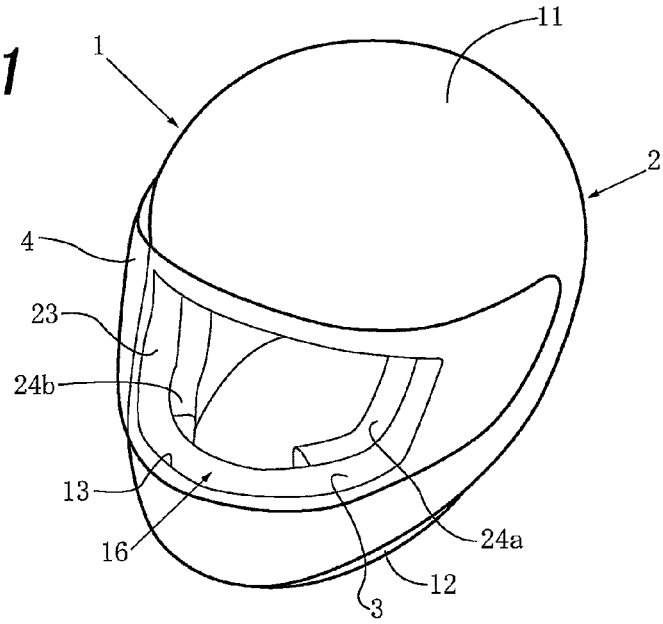
FIG. 1 is an overall schematic perspective view of a helmet of the first embodiment in which the present invention is applied to a full-face-type helmet.
Figure 2:
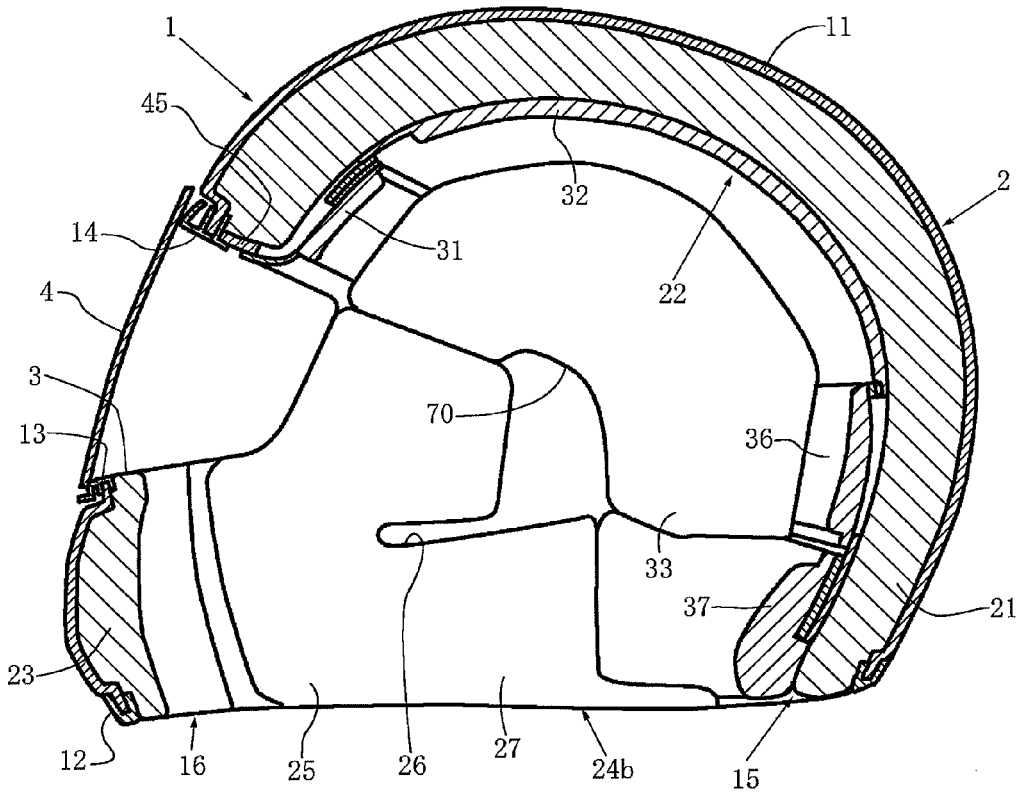
FIG. 2 is an enlarged centrally longitudinal sectional view of the helmet in FIG. 1.

As shown in FIGS. 1 and 2, a full-face-type helmet 1 comprises the members described in the following items (a) to (c):

(a) a full-face-type cap-like head protecting body 2 to be worn on the head of a helmet wearer such as a motorbike rider, (b) a shield 4 capable of opening/closing a window opening 3 formed in the front surface of the head protecting body 2 to oppose a portion between the forehead and chin (i.e., the central portion of the face) of the helmet wearer, and (c) a pair of left and right chin straps (not shown) attached to the inside of the head protecting body 2.

As has been conventionally known, the shield 4 can be made of a transparent or translucent hard material such as polycarbonate or another hard synthetic resin. A pair of left and right attaching screws (not shown) pivotally attach the shield 4 at the left and right ends to the head protecting body 2. The shield 4 can close the window opening 3 when it is at the backward pivotal position shown in FIGS. 1 and 2, open the window opening 3 when it is at the forward pivotal position where it has pivoted upward from the backward pivotal position, and partially open the window opening 3 when it is at the intermediate position between the two positions. Furthermore, as has been conventionally known, the head protecting body 2 shown in FIGS. 1 and 2 can incorporate one or a plurality of types of ventilator mechanisms as needed.

As shown in FIGS. 1 and 2, the head protecting body 2 comprises the members described in the following items (d) to (h):

(d) a full-face-type cap-like outer shell 11 which forms the circumferential wall of the head protecting body 2, (e) a lower rim member 12 which has a substantially U-shaped section and is attached to the outer shell 11 throughout the entire periphery of the lower end of the outer shell 11 by adhesion or the like, (f) a window opening rim member 14 which has a substantially E-shaped section and is attached to the window opening 13, formed in the outer shell 11 to form the window opening 3 of the head protecting body 2, throughout the entire periphery of the window opening 13 by adhesion or the like, (g) a cap-like head backing member 15 which is attached inside the outer shell 11 by adhesion or the like in contact with the inner surface of the outer shell 11 in a fore-head region, a vertex region, left and right temple regions and an occiput region substantially respectively opposing the fore-head part, vertex part, left and right temple parts and occiput part of the head of the helmet wearer, and (h) a chin-and-cheek backing member 16 which is attached inside the outer shell 11 by adhesion or the like in contact with the inner surface of the outer shell 11 in a chin region and a cheek region substantially respectively opposing the chin and cheek of the helmet wearer.

The outer shell 11 can be made of a composite material formed by lining the inner surface of a strong shell main body made of FRP, or another hard synthetic resin or the like with a flexible sheet such as porous unwoven fabric. The lower rim member 12 can be made of foamed vinyl chloride, synthetic rubber, another soft synthetic resin, or the like. The window opening rim member 14 can be made of synthetic rubber or another highly flexible elastic material.

The cap-like head backing member 15 shown in FIG. 2 comprises the members described in the following items (i) and (j):

(i) a cap-like impact-on-the-head absorbing liner 21 disposed inside the cap-like outer shell 11 and attached to the outer shell 11, and (j) an air-permeable cap-like head backing cover (in other words, a cap-like head inside pad) 22 disposed inside the impact-on-the-head absorbing liner 21 to cover substantially the entire inner surface of the impact-on-the-head absorbing liner 21 and attached to the impact-on-the-head absorbing liner 21.

As shown in FIGS. 1 and 2, the chin-and-cheek backing member 16 comprises the members described in the following items (k) and (l);

(k) an impact-on-the-chin-and-cheek absorbing liner 23, and (l) a pair of left and right cheek blockish inside pads 24*a* and 24*b* attached to the impact-on-the-chin-and-cheek absorbing liner 23 in contact with the inner surface of the left and right cheek regions of the impact-on-the-chin-and-cheek absorbing liner 23 substantially respectively opposing the left and right cheeks of the helmet wearer.

The main body portions of the impact-on-the-head absorbing liner 21 and impact-on-the-chin-and-cheek absorbing liner 23 shown in FIG. 2 can be made of a material with appropriate rigidity and appropriate plasticity such as foamed polystyrene or another synthetic resin. The cover main body portion of the head backing cover 22 can be made of a combination of a woven fabric portion, a porous unwoven fabric portion, or the like formed by laminating elastic layers, having appropriate shapes and made of a highly flexible elastic material such as urethane foam or another formed synthetic resin, on a surface (i.e., the outer surface) which opposes the impact-on-the-head absorbing liner 21, or two side surfaces. The practical arrangement of the cap-like head backing cover 22 will be described in detail in the next section (i.e., the section "2. Practical Arrangement of Cap-Like Head Backing Cover").

The pair of left and right cheek blockish inside pads 24*a* and 24*b* shown in FIGS. 1 and 2 are symmetrical to each other. Hence, the right cheek blockish inside pad 24*b* will be described with reference to FIGS. 1 and 2, and a description on the left cheek blockish inside pad 24*a* will be omitted where appropriate. More specifically, the right cheek blockish inside pad 24*b* shown in FIGS. 1 and 2 comprises the members described in the following items (m) and (n):

(m) a pad main body 25, and (n) an elongated engaging member (not shown) attached to near the lower end of the pad main body 25 throughout substantially its entire length by sewing, taping, adhesion, or the like.

The pad main body 25 has a notch 26 to substantially exclude an ear region substantially corresponding to the right ear of the helmet wearer. Accordingly, the pad main body 25 has a shape corresponding to the right cheek and its vicinity (excluding the right ear) of the helmet wearer. The pad main body 25 comprises the members described in the following items (o) and (p):

(o) a thick plate-like cushion member (not shown) which is formed of one or a plurality of highly flexible elastic members such as urethane form or another flexible foamed synthetic resin, and (p) a bag-like member 27 which covers the cushion member substantially entirely like a bag.

Hence, the cushion member is accommodated in and attaches to the bag-like member 27. The bag-like member 27 may be formed by connecting one or a plurality of types of portions of a synthetic leather portion such as vinyl leather, a woven fabric portion, and a porous unwoven fabric portion (depending on the case, an arbitrary flexible sheet material portion such as nonporous unwoven fabric, a synthetic resin sheet, paper, synthetic-resin-laminated paper, or natural leather) by sewing, adhesion, or the like.

To attach the right cheek blockish inside pad 24*b* shown in FIGS. 1 and 2 to the impact-on-the-chin-and-cheek absorbing liner 23 shown in FIGS. 1 and 2, the female portion (i.e., female hook) of each of one or a plurality of round hooks (not shown) may be attached to one of the inside pad 24 and impact absorbing liner 23, and the male hook of each round hook may be attached to the remaining one. When attaching the inside pad 24*b* to the impact absorbing liner 23, for example, the male hook of the inside pad 24*b* may be recess-projection engaged with, e.g., the female hook of the impact absorbing liner 23. In this case, the longitudinal engaging member of the inside pad 24*b* is inserted between the outer shell 11 and impact-on-the-chin-and-cheek absorbing liner 23 in advance from below.

2. Practical Arrangement of Cap-Like Head Backing Cover

Figure 3:
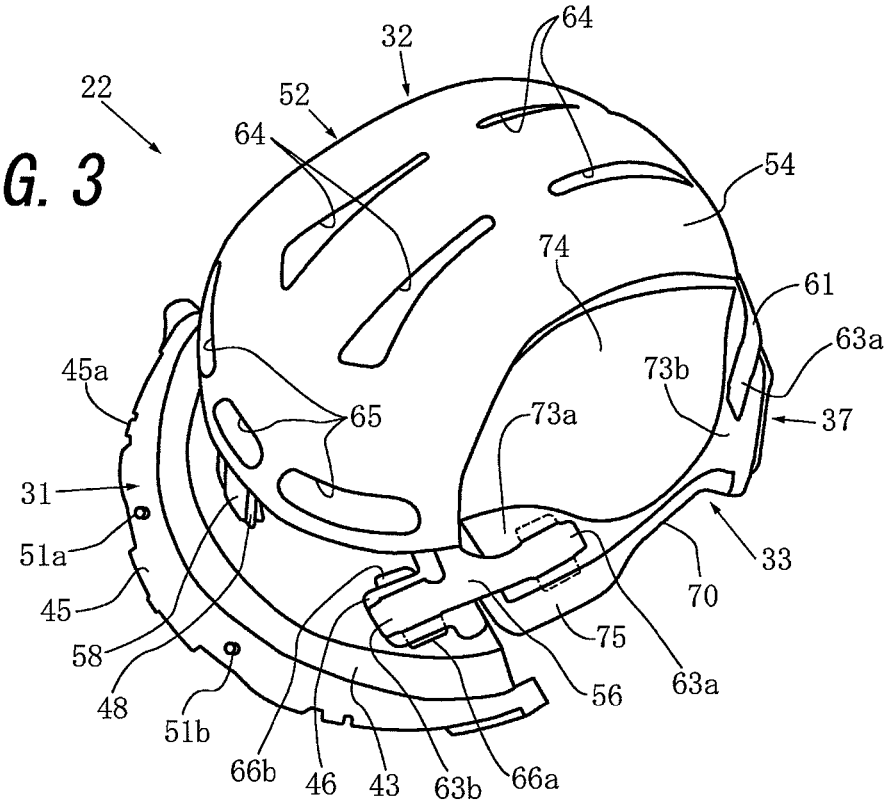
FIG. 3 is a perspective view, seen from the obliquely front side, of the head backing cover of the helmet in FIG. 1.
Figure 4:
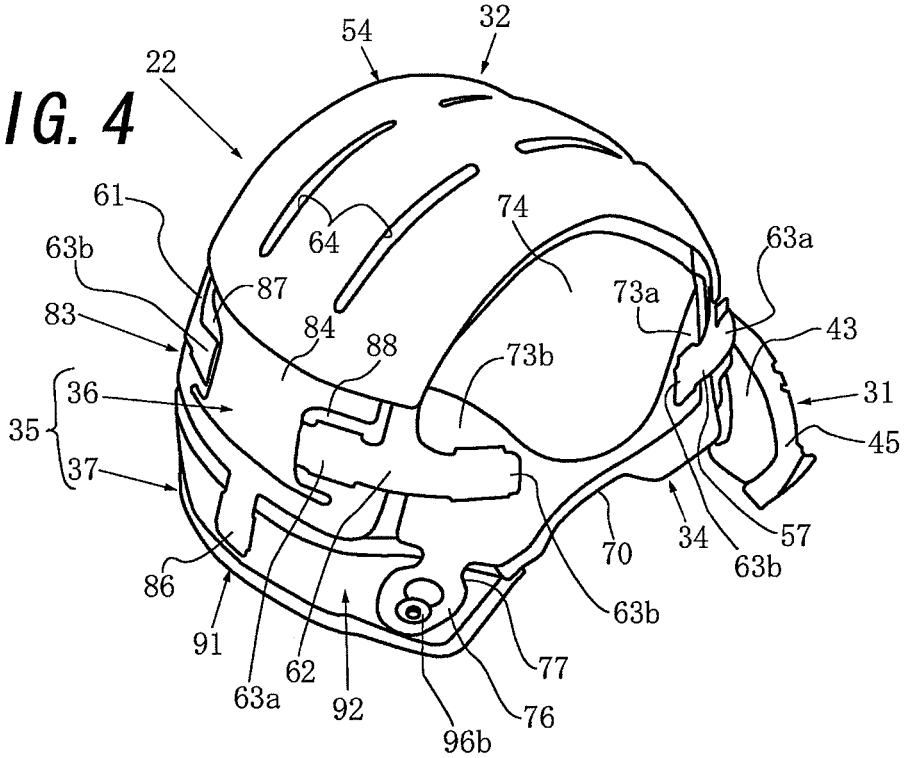
FIG. 4 is a perspective view, seen from the obliquely rear side, of the head backing cover in FIG. 3.
Figure 5:
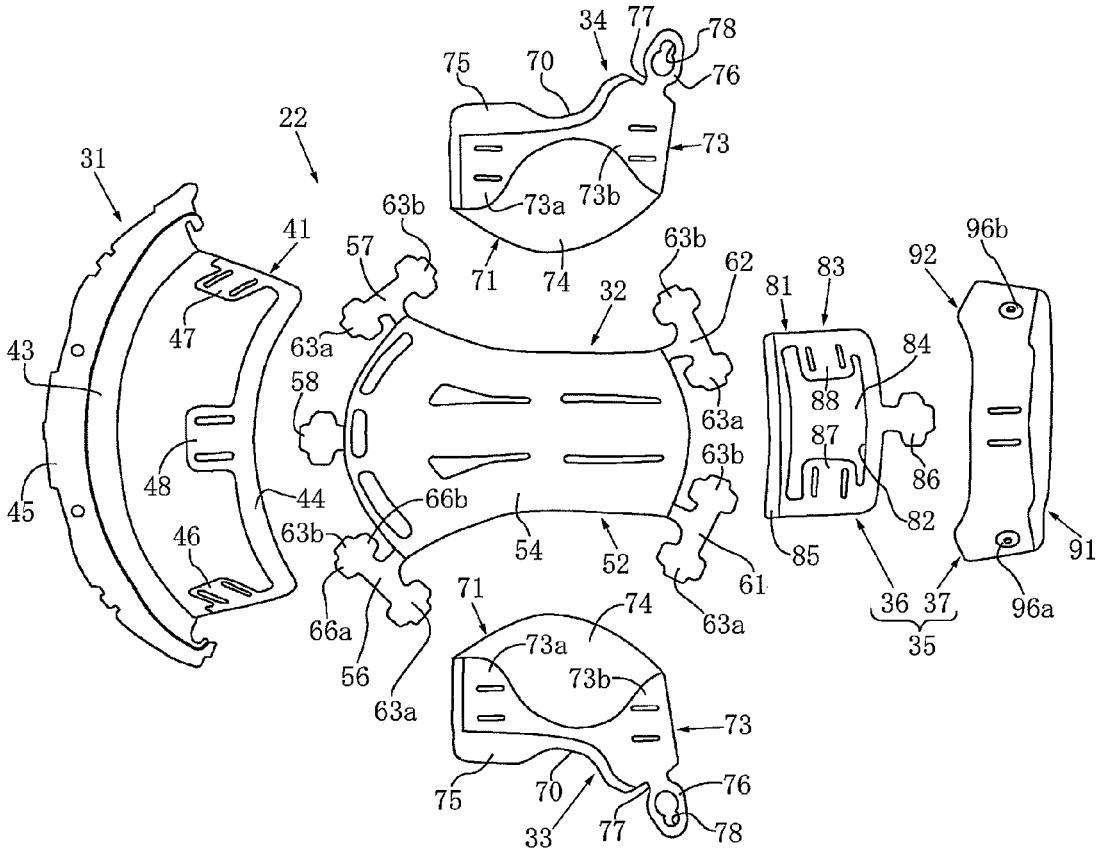
FIG. 5 is a plan view of a state in which the head backing cover in FIG. 3 is exploded and, as needed, developed.

The cap-like head backing cover (in other words, cap-like head inside pad) 22 is formed by combining and connecting a plurality of types of cover components, as shown in FIGS. 3 to 5. More specifically, the head backing cover 22 may comprise the members described in the following items (a) to (e):

(a) a cover component (in other words, cover unit or cover constituent element) 31 for the fore-head part of the head, (b) a cover component 32 for the vertex part of the head, (c) a cover component 33 for the left-side part of the head (i.e., left temple part of the head), (d) a cover component 34 for the right-side part of the head (i.e., right temple part of the head), and (e) a cover component 35 for the occiput part of the head.

Each of the cover components 31 to 35 may be a single cover component, or a composite-type cover component formed by separably combining and connecting a plurality of cover components. More specifically, the occiput part cover component 35 may comprise a composite-type occiput part cover component formed of a cover component 36 for the upper occiput part of the head (in other words, the upper portion of the occiput part of the head) and a cover component 37 for the lower occiput part of the head (in other words, the lower portion of the occiput part of the head).

The respective cover components (in other words, the respective head inside pad components 31 to 37) of the head backing cover 22 shown in FIGS. 3 to 5 substantially oppose to the respective portions of the head of the helmet wearer when the cover components are built into the cap-like head protecting body 2. Hence, the fore-head part cover component 31, vertex part cover component 32, left temple part cover component 33, right temple part cover component 34 and occiput part cover component 35 are arranged to be substantially respectively located at the fore-head region, vertex region, left temple region, right temple region and occiput region of the inner surface of the head protecting body 2 substantially respectively opposing the fore-head part, vertex part, left temple part, right temple part and occiput part of the head of the helmet wearer. The upper occiput part cover component 36 and lower occiput part cover component 37 are arranged to be located at substantially the upper portion and lower portion, respectively, of the occiput region of the inner surface of the head protecting body 2 substantially respectively opposing the upper occiput part and lower occiput part of the head of the helmet wearer.

The respective cover components 31 to 37 shown in FIGS. 3 to 5 comprise the members described in the following items (f) and (g):

(f) a cover main body portion 41, and (g) one or a plurality of connecting members provided with one or a plurality of connecting means for connecting the cover main body portion 41 to the adjacent cover main body portions of another cover components 31 to 37.

The practical arrangement of the respective cover components 31 to 37 will be described in "(1) Fore-head Part Cover Component", "(2) Vertex Part Cover Component", "(3) Left and Right Temple Part Cover Components" and "(4) Occiput Part Cover Component" with reference to FIGS. 3 to 15.

(1) Fore-Head Part Cover Component

Figure 6:
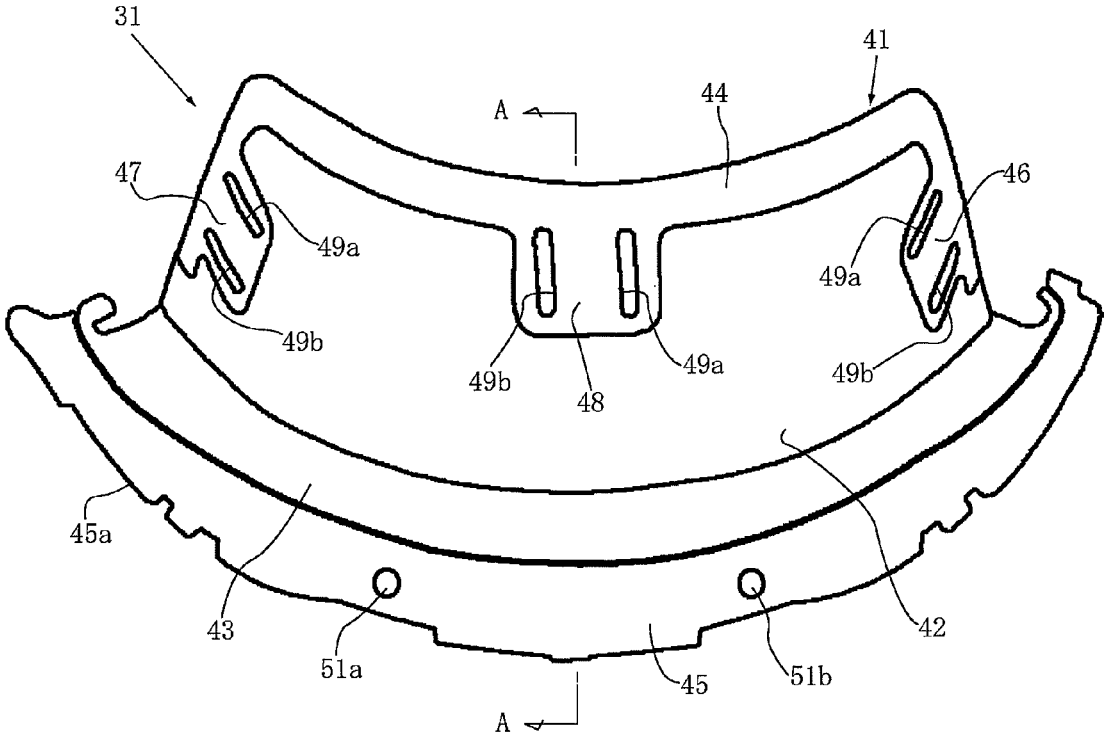
FIG. 6 is a front view of the fore-head part cover component in FIG. 5.
Figure 7:
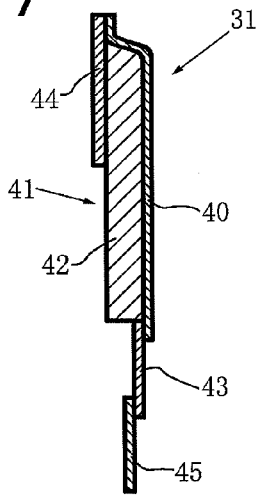
FIG. 7 is a sectional view taken along the line A-A of FIG. 6.

The cover main body portion 41 of the fore-head part cover component 31 shown in FIGS. 6 and 7 has a shape substantially corresponding to the fore-head part of the head of the helmet wearer. The cover main body portion 41 may comprise the portions described in the following items (h) and (i):

(h) a first portion 40 of a cloth (more specifically, a laminate of porous unwoven fabrics or woven fabrics) with an outer surface to which an elastic layer (to be merely referred to as "the elastic layer" hereinafter) 42 made of a highly flexible elastic material such as urethane foam or another foamed synthetic resin and having an appropriate shape (that is, a shape substantially corresponding to the fore-head part of the head of the helmet wearer) is laminated by sewing, adhesion, welding under pressure, or the like, and (i) a second portion 43 of a cloth (more specifically, a laminate of porous unwoven fabrics or woven fabrics) connected to the first portion 40 of the cloth by sewing, adhesion, or the like.

An elongated plate-like flexible first connecting member 44 is attached to the cover main body portion 41 by sewing, adhesion, thermal welding, or the like as it overlies on the elastic layer 42 (and accordingly the first portion 40 of the cloth indirectly) so as to extend substantially along the upper end of the outer surface of the cover main body portion 41. An elongated plate-like flexible second connecting member 45 is attached to the cover main body portion 41 by sewing or the like to extend further downward from the second portion 43 of the cloth substantially along the lower end of the outer surface of the cover main body portion 41.

The first connecting member 44 shown in FIGS. 6 and 7 has first to third plate-like projecting pieces 46 to 48 at substantially its two ends and substantially its center. Each of the first to third projecting pieces 46 to 48 has a pair of left and right slit-like holes (in other words, slit-like through holes) 49*a* and 49*b* which extend substantially parallel to each other and function as target insertion engaging portions for insertion engagement (in other words, one constituent element of connecting means). More specifically, the slit-like holes 49*a* and 49*b* of each of the first and second projecting pieces 46 and 47 may extend substantially horizontally as they substantially oppose each other. The slit-like holes 49*a* and 49*b* of the third projecting piece 48 may extend substantially vertically as they substantially oppose each other.

The second connecting member 45 shown in FIGS. 6 and 7 is connected to a third connecting member (not shown) disposed on the lower surface of the front end of the impact-on-the-head absorbing liner 21. The second connecting member 45 serves as an insertion engaging portion for insertion engagement. As has been conventionally known, the second connecting member 45 is inserted in the slit-like target inserting portion (not shown; serving as the target insertion engaging portion for insertion engagement) of the third connecting member substantially with its entire length and entire width, and is engaged with the third connecting member. A pair of left and right engaging projections 51*a* and 51*b* serving as, e.g., projection-type engaging portions for recess-projection engagement, project on the front surface of the second connecting member 45. Upon insertion, the projections 51*a* and 51*b* are inserted in, e.g., a pair of left and right engaging holes (not shown; serving as recessed engaging portions for recess-projection engagement) formed in the third connecting member, and engaged in the engaging holes. A lower end 45*a* of the second connecting member 45 has steps along its longitudinal direction so as to conform to the shape of the slit-like target inserting portion of the third connecting member. Although not shown, the elastic layer 42 and the first and second connecting members 44 and 45 can have through holes such as round ones or slit-like ones, recesses, or the like, as needed, for one or a plurality of purposes such as adding permeability, weight reduction, adding flexibility, adding beauty and the like. Such through holes, recesses and the like can similarly be formed in the other cover components 32 to 37 as well.

The remaining cover components 32 to 37 shown in FIG. 5 will be described in detail. Regarding the cover components 32 to 37, a description on matters that can be substantially the same as in the fore-head part cover component 31 described above may be omitted when appropriate.

(2) Vertex Part Cover Component

Figure 8:
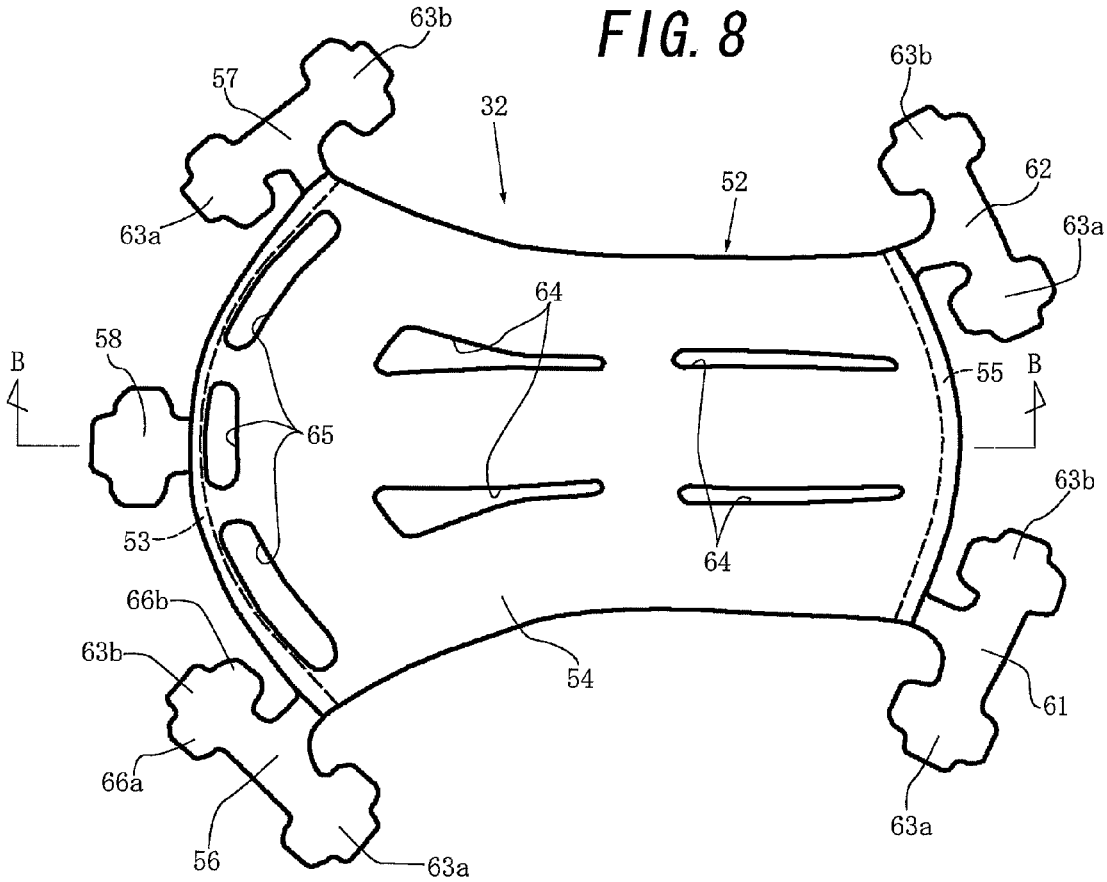
FIG. 8 is a plan view in a developed state of the vertex part cover component in FIG. 5.
Figure 9:
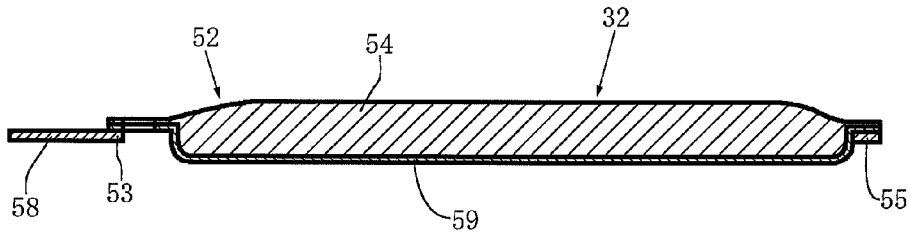
FIG. 9 is a sectional view taken along the line B-B of FIG. 8.

The vertex part cover component 32 shown in FIGS. 8 and 9 has a cover main body portion 52 with a shape substantially corresponding to the vertex part of the head of the helmet wearer. The cover main body portion 52 may have substantially the same arrangement as that of the cover main body portion 41 except for its shape. An elongated plate-like first connecting member 53 is attached to the cover main body portion 52 by sewing, adhesion, thermal welding, or the like as it overlies on an elastic layer 54 (and accordingly a cloth portion 59 indirectly) corresponding to the elastic layer 42 so as to extend substantially along the front end of the inner surface of the cover main body portion 52. An elongated plate-like second connecting member 55 is attached to the cover main body portion 52 by sewing or the like as it overlies on the elastic layer 54 to extend substantially along the rear end of the inner surface of the cover main body portion 52.

The first connecting member 53 shown in FIGS. 8 and 9 has first to third plate-like projecting pieces 56 to 58 at substantially its left and right ends and substantially at its center, respectively. The first and second projecting pieces 56 and 57 may project obliquely outward to the left and right, respectively, and obliquely forward, to each form a substantially T shape (in other words, to have a narrow base). The third projecting piece 58 may project substantially forward to form a substantially cross shape (in other words, to have a narrow base) so that it serves as an insertion engaging portion for insertion engagement. The second connecting member 55 has fourth and fifth projecting pieces 61 and 62 at substantially its left and right ends. The fourth and fifth projecting pieces 61 and 62 may project obliquely outward to the left and right, respectively, and obliquely backward, to each form a substantially T shape (in other words, to have a narrow base). Each of the first, second, fourth and fifth projecting pieces 56, 57, 61 and 62 has engaging portions 63*a* and 63*b*, at the left and right ends of the substantially T shape, which have substantially cross shapes (in other words, narrow bases) to serve as insertion engaging portions for insertion engagement (in other words, the other constituent element). The cover main body portion 52 has, near its center, one or a plurality of slit-like holes 64 extending in the back-and-forth direction. The cover main body portion 52 also has one or a plurality of slit-like holes 65 extending along the rear end of the first connecting member 53. By thermally welding the cover main body portion 52 partially at its peripheral portion, around the slit-like holes 64 and 65 and the like with a high pressure, the elastic layer 54 and the cloth portion 59 can be thermally welded to each other, and the thickness of the elastic layer 54 can be decreased greatly.

(3) Left and Right Temple Part Cover Components

Figure 10:
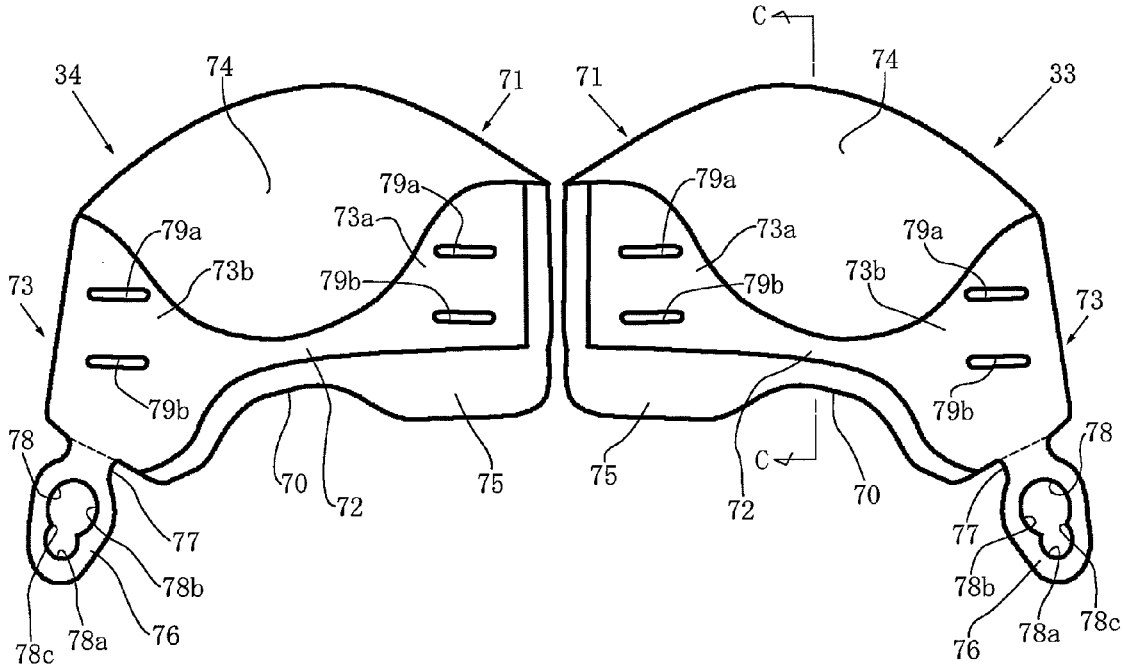
FIG. 10 is a front view of left and right temple part cover components in FIG. 5.
Figure 11:
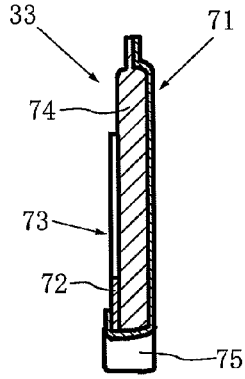
FIG. 11 is a sectional view taken along the line C-C of FIG. 10.

Of the left and right temple part cover components 33 and 34 shown in FIGS. 10 and 11, the right temple part cover components 34 can be arranged to be substantially axi-symmetrical with the left temple part cover component 33. Hence, the left temple part cover component 33 will be described in detail hereinafter, and a repetitive description on the right temple part cover component 34 will be omitted when appropriate.

The left temple part cover component 33 shown in FIGS. 10 and 11 has a cover main body portion 71 with a shape substantially corresponding to the left temple part of the head of the helmet wearer. The cover main body portion 71 may have substantially the same arrangement as that of the cover main body portion 41 except for its shape. A plate-like connecting member 73 which is very narrow at substantially its intermediate portion 72 is attached to the cloth portion 75 by sewing, adhesion, thermal welding, or the like at its lower end as it overlies on an elastic layer 74 (and accordingly a cloth portion 75 indirectly) corresponding to the elastic layer 42 so as to extend substantially along near the lower portion of the outer surface of the cover main body portion 71.

That portion of the connecting member 73 shown in FIGS. 10 and 11 near the lower end of its rear portion projects from the cover main body portion 71 substantially downward (slightly obliquely backward) to form an engaging portion 76 serving as a recessed engaging portion for recess-projection engagement. The engaging portion 76 has a narrow base to form a narrow portion 77, and a potbelly hole 78 on its distal end side. The potbelly hole 78 has a small-diameter hole 78*a* on its distal end side and a large-diameter hole 78*b* on its proximal end side, and a narrow portion 78*c* between the holes 78*a* and 78*b*. Each of front and rear portions 73*a* and 73*b* of the connecting member 73 has a pair of left and right slit-like holes (in other words, slit-like through holes) 79*a* and 79*b* extending substantially parallel to each other and serving as target insertion engaging portions for insertion engagement. More specifically, the pair of left and right slit-like holes 79*a* and 79*b* of each of the front portion 73*a* and rear portion 73*b* may extend substantially in the horizontal direction as they substantially oppose each other.

(4) Occiput Part Cover Component

Figure 12:
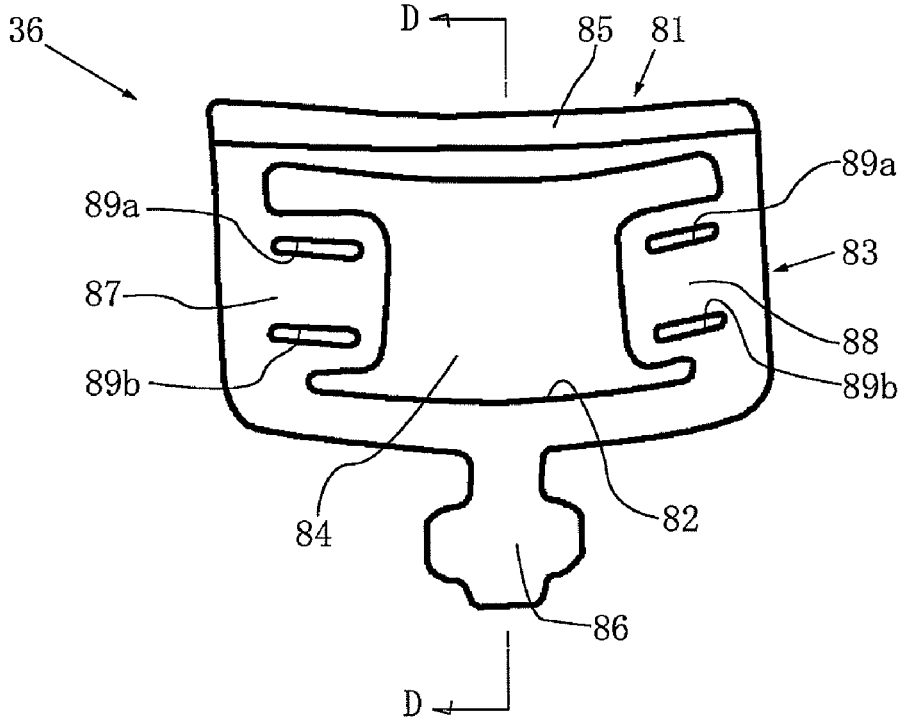
FIG. 12 is a front view of an upper occiput part cover component in FIG. 5.
Figure 13:
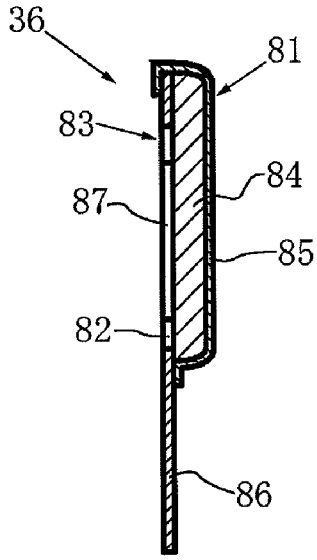
FIG. 13 is a sectional view taken along the line D-D of FIG. 12.
Figure 14:
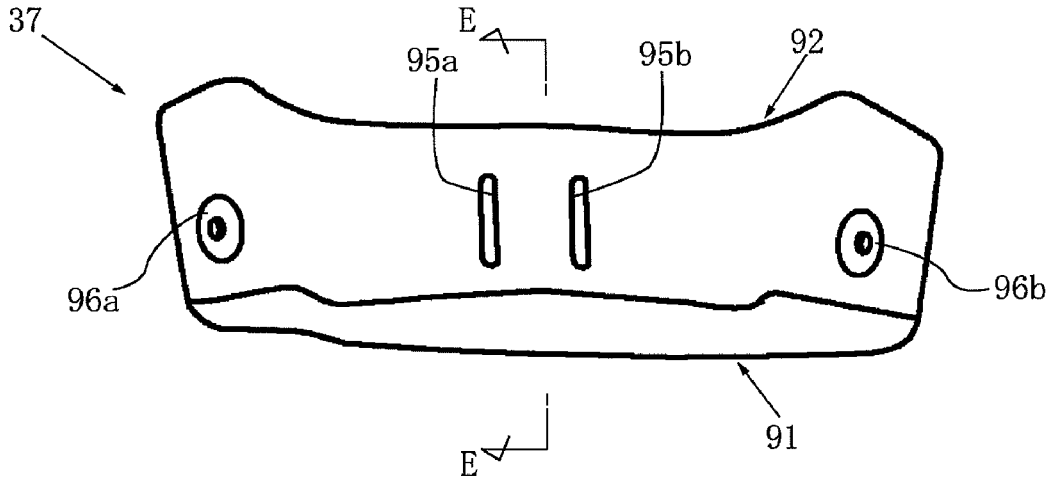
FIG. 14 is a front view of a lower occiput part cover component in FIG. 5.
Figure 15:
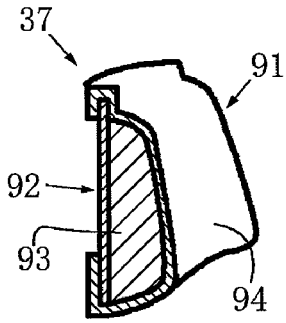
FIG. 15 is a sectional view taken along the line E-E of FIG. 14.

The occiput part cover component 35 shown in FIGS. 4 and 5 comprises the members described in the following items (j) and (k):

(j) the upper occiput part cover component 36 shown in FIGS. 12 and 13, and (k) the lower occiput part cover component 37 shown in FIGS. 14 and 15.

The upper occiput part cover component 36 is provided with a cover main body portion 81 having a shape substantially corresponding to the upper portion of the occiput part of the head of the helmet wearer. The cover main body portion 81 may have substantially the same arrangement as that of the cover main body portion 41 except for its shape. A connecting member 83 having a large hole 82 at substantially its center is attached to the cloth portion 85 (only at the upper end of the connecting member 83) and the cover main body portion 81 (only at the end excluding the upper end of the connecting member 83) by sewing, adhesion, thermal welding, or the like at its peripheral edge located at substantially its entire circumference as it overlies on an elastic layer 84 (and accordingly a cloth portion 85 indirectly) corresponding to the elastic layer 42 so as to extend throughout substantially the entire surface of the outer surface of the cover main body portion 81 except for the upper end.

Substantially the central portion of the lower end of the connecting member 83 of the upper occiput part cover component 36 shown in FIGS. 12 and 13 projects substantially downward to form a first plate-like projecting piece 86 having a substantially cross shape (in other words, a narrow base) and serving as an insertion engaging portion for insertion engagement. The left and right portions of the connecting member 83 have second and third plate-like projecting pieces 87 and 88 projecting toward the central hole 82 from the left and right portions, respectively, of the connecting member 83. Each of the second and third plate-like projecting pieces 87 and 88 has a pair of left and right slit-like holes (in other words, slit-like through holes) 89*a* and 89*b* extending substantially parallel to each other and serving as target insertion engaging portions for insertion engagement. More specifically, the slit-like holes 89*a* and 89*b* of each of the second and third plate-like projecting pieces 87 and 88 may extend substantially in the horizontal direction as they substantially oppose each other.

The lower occiput part cover component 37 shown in FIGS. 14 and 15 comprises a cover main body portion 91 having a shape substantially corresponding to the lower portion of the occiput part of the head of the helmet wearer. When the upper occiput part cover component 36 and lower occiput part cover component 37 are combined and connected to each other to form the occiput part cover component 35, the composite-type cover main body portions 81 and 91 comprising the cover main body portion 81 of the upper occiput part cover component 36 and the cover main body portion 91 of the lower occiput part cover component 37 have a shape substantially opposing the occiput part of the head of the helmet wearer.

The cover main body portion 91 of the lower occiput part cover component 37 shown in FIGS. 14 and 15 is provided with a substantially rectangular connecting member 92. The connecting member 92 is attached to a cloth portion 94 by sewing, adhesion or the like at its peripheral edge located substantially at its entire circumference as it overlies on an elastic layer 93 (and accordingly the cloth portion 94 indirectly) corresponding to the elastic layer 42 so as to extend throughout substantially the entire surface of the outer surface of the cover main body portion 91 except for the lower end. In this case, the cover main body portion 91 (and accordingly the elastic layer 93 indirectly) of the lower occiput part cover component 37 substantially opposes the nape of the neck of the helmet wearer. Hence, the elastic layer 93 preferably has a larger thickness than that of the elastic layer of any other cover component, as shown in FIG. 15.

The connecting member 92 of the lower occiput part cover component 37 shown in FIGS. 14 and 15 has, substantially at its center, a pair of left and right slit-like holes (in other words, slit-like through holes) 95*a* and 95*b* extending substantially parallel to each other and serving as target insertion engaging portions for insertion engagement. More specifically, the pair of left and right slit-like holes 95*a* and 95*b* may extend substantially in the vertical direction as they substantially oppose each other. A pair of left and right male portions (i.e., male hooks) 96*a* and 96*b* of a pair of left and right round hooks serving as projecting engaging portions for recess-projection engagement are attached to near the left and right ends, respectively, of the connecting member 92. When attaching the cap-like head backing member 15 shown in FIGS. 3 to 5 to the inner surface of the cap-like impact-on-the-head absorbing liner 21, the pair of male hooks 96*a* and 96*b* can fit in a pair of left and right female hooks (not shown; respectively serving as recessed engaging portions for recess-projection engagement) attached to those portions of the inner surface of the impact-on-the-head absorbing liner 21 which substantially oppose the male hooks 96*a* and 96*b*.

3. How to Assemble Cover Components

By combining and connecting the six types of cover components 31 to 34, 36 and 37 shown in FIG. 5 separably (in other words, to be able to separate from each other easily) as will be described later, the cap-like head backing cover 22 shown in FIGS. 3 and 4 can be assembled. Conversely, by disengaging connection of the cap-like head backing cover 22 shown in FIGS. 3 and 4, the head backing cover 22 can be dismantled (that is, separated apart) into the six types of cover components shown in FIG. 5. As a matter of course, in this case, the head backing cover 22 will not be separated apart into the six types of cover components 31 to 34, 36 and 37 but can be separated into a plurality of arbitrary types, between two and five types, of cover components (in other words, cover components including a composite-type cover component) 31 to 37. The procedure of combining and connecting the six types of cover components 31 to 34, 36 and 37 shown in FIG. 5 is not limited specifically. This applies to the procedure of separation. However, an assembling method that can combine and connect the six types of cover components 31 to 34, 36 and 37 comparatively easily is the method of connecting the cover components 31 to 34 and 36 to the periphery of the vertex cover component 32 as the center and subsequently connecting the lower occiput part cover component 37 to the upper occiput part cover component 36. An example of the procedure of such an assembling method is as described in the following items (a) to (e):

(a) inserting a pair of projections (in other words, a pair of inserting portions) located on the two sides of each of the cross-shaped engaging portion 63*b* of the first plate-like projecting piece 56, the cross-shaped engaging portion 63*a* of the second plate-like projecting piece 57 and the cross-shaped third plate-like projecting piece 58 of the vertex part cover component 32 sequentially into the pair of slit-like holes 49*a* and 49*b* of the corresponding one of the first to third plate-like projecting pieces 46 to 48 of the fore-head part cover component 31, sequentially, thus combining and connecting the fore-head part cover component 31 to the vertex part cover component 32, as shown in FIG. 3, (b) inserting a pair of projections (in other words, a pair of inserting portions) located on the two sides of each of the cross-shaped engaging portion 63*a* of the first plate-like projecting piece 56 and the cross-shaped engaging portion 63*a* of the fourth projecting piece 61 of the vertex part cover component 32 into the pair of slit-like holes 79*a* and 79*b* of the corresponding one of the front portion 73*a* and rear portion 73*b* of the connecting member 73 of the left temple part cover component 33, sequentially, thus combining and connecting the left temple part cover component 33 to the vertex part cover component 32, as shown in FIG. 3, (c) inserting a pair of projections (in other words, a pair of inserting portions) located on the two sides of each of the cross-shaped engaging portion 63*b* of the second plate-like projecting piece 57 and the cross-shaped engaging portion 63*b* of the fifth plate-like projecting piece 62 of the vertex part cover component 32 into the pair of slit-like holes 79*a* and 79*b* of the corresponding one of the front portion 73*a* and rear portion 73*b* of the connecting member 73 of the right temple part cover component 34, sequentially, thus combining and connecting the right temple part cover component 34 to the vertex part cover component 32, as shown in FIG. 4, (d) inserting the pair of projections (in other words, a pair of inserting portions) located on the two sides of each of the cross-shaped engaging portion 63*b* of the fourth plate-like projecting piece 61 and the cross-shaped engaging portion 63*a* of the fifth projecting piece 62 of the vertex part cover component 32 into the pair of slit-like holes 89*a* and 89*b* of the corresponding one of the second and third plate-like projecting pieces 87 and 88 of the connecting member 83 of the upper occiput part cover component 36, sequentially, thus combining and connecting the upper occiput part cover component 36 to the vertex part cover component 32, as shown in FIG. 4, and (e) inserting the pair of left and right male hooks 96*a* and 96*b* of the lower occiput part cover component 37 into the large-diameter holes 78*b* of the potbelly holes 78 of the left temple part cover component 33 and right temple part cover component 34, respectively, pulling the lower occiput part cover component 37 substantially downward to shift the male hooks 96*a* and 96*b* from the large-diameter holes 78*b* to the small-diameter holes 78*a* through the narrow portions 78*c*, respectively, of the potbelly holes 78 and, substantially simultaneously (in other words, before or after), inserting a pair of projections (in other words, a pair of inserting portions) located on the two sides of the cross-shaped first plate-like projecting piece 86 of the upper occiput part cover component 36 into the pair of slit-like holes 95*a* and 95 of the connecting member 92 of the lower occiput part cover component 37, sequentially, thus combining and connecting the lower occiput part cover component 37 to the right and left temple part cover components 33 and 34 and the upper occiput part cover component 36, as shown in FIG. 4 (accordingly, the male hooks 96*a* and 96*b* have both the function of connecting the lower occiput part cover component 37 to the impact-on-the-head absorbing liner 21 and the function of connecting the lower occiput part cover component 37 to the left and right temple part cover components 33 and 34).

The pair of projections of the cross-shaped engaging portion can be inserted into the pair of slit-like holes with the procedure described in the above items (a) to (e) with the same manipulation. For example, the case, described in the above item (a), of inserting the pair of projections 66*a* and 66*b* located on the two sides of the cross-shaped engaging portion 63*b* of the first plate-like projecting piece 56 into the pair of slit-like holes 49*a* and 49*b* of the first projecting piece 46 will be described with reference to FIGS. 3, 6 and 8. This insertion is done in accordance with the procedure described in the following items (f) and (g):

(f) first, bending the cross-shaped engaging portion 63*b* into a convex shape (in other words, by elastic deformation) between the pair of projections 66*a* and 66*b*, and (g) subsequently, abutting the distal ends of the pair of projections 66*a* and 66*b* against the pair of slit-like holes 49*a* and 49*b* and canceling the elastic deformation (in this case, as the pair of projections 66*a* and 66*b* are respectively inserted into the pair of slit-like holes 49*a* and 49*b*, as shown in FIG. 3, the cross-shaped engaging portion 63*b* is inserted in and engaged with the first projecting piece 46 comparatively firmly).

When separating apart the head backing cover 22 shown in FIGS. 3 and 4 into the six types or the like of cover components 31 to 34, 36 and 37 shown in FIG. 5, an manipulation with the procedure opposite to that described in the above items (a) to (e) may be performed.

The outer surface of the head backing cover 22 shown in FIGS. 3 and 4 which is assembled in accordance with the procedure described in the above items (a) to (e) may have substantially the same shape as that of the inner surface of the impact-on-the-head absorbing liner 21 shown in FIG. 2. More specifically, the shape of the outer surface of the head backing cover 22 may be different from that of the inner surface of the impact absorbing liner 21 only in the respects described in the following items (h) and (i):

(h) the fact that the second portion 43 of the cloth of the fore-head part cover component 31 and the second connecting member 45 shown in FIG. 6 are abutted not against the inner surface of the impact absorbing liner 21 but against the lower surface of the front end of the impact absorbing liner 21, as shown in FIG. 2, and (i) the fact that the left and right temple part cover components 33 and 34 respectively have left and right notches 70 substantially corresponding to the ears of the helmet wearer at substantially the central portions of the lower ends of the left and right temple part cover components 33 and 34, as shown in FIGS. 2 to 5 and FIG. 10, and that accordingly those portions of the inner surface of the impact absorbing liner 21 which substantially correspond to the notches 70 are exposed from the head backing cover 22.

The head backing cover 22 shown in FIGS. 3 and 4 which is assembled in accordance with the procedure described in the above items (a) to (e) may be attached to the impact-on-the-head absorbing liner 21 in accordance with the procedure described in the following items (j) and (k):

(j) fitting the pair of left and right male hooks 96*a* and 96*b* provided to the lower occiput part cover component 37 with the pair of left and right female hooks provided to the inner surface of the impact-on-the-head absorbing liner 21, as described in the above item 2(4), and (k) inserting the second connecting member 45 of the fore-head part cover component 31 into the slit-like target inserting portion of the third connecting member of the impact-on-the-head absorbing liner 21 so as to engage with it, as described in the above item 2(1), substantially simultaneously (in other words, before or after) with the procedure described in the above item (j), and inserting the pair of engaging projections 51*a* and 51*b* of the second connecting member 45 into the pair of engaging holes of the third connecting member so as to be engaged by recess-projection engagement.

By performing the procedure described in the above items (j) and (k), the head backing cover 22 can be attached to the impact absorbing liner 21 as the outer surface of the head backing cover 22 abuts against the inner surface of the impact-on-the-head absorbing liner 21. When removing the head backing cover 22 from the impact absorbing liner 21, a manipulation with the procedure opposite to that described in the items (j) and (k) may be performed.

4. How to Adjust Helmet Size

The size adjustment personnel for the salesperson of the helmet shop, the prospective helmet wearer or the like can adjust the size of the helmet 1 in accordance with the procedure described in the following items (a) to (c):

(a) preparing a plurality of types of cover components having different thicknesses (and, depending on the case, sizes, shapes and the like) for one type, a plurality of types, or all the types among the six types of cover components 31 to 34, 36 and 37 of the cap-like head backing cover 22 in advance (the thickness of the cover component can be changed easily by changing the thickness of the elastic layer that forms the cover component), (b) measuring the back-and-forth length, left-and-right width and/or circumferential length of the head of the prospective helmet wearer, or letting the prospective helmet wearer to actually try the helmet (or only the head backing cover 22 depending on the case), thus determining whether one type, the plurality of types, or all the types among the six types of cover components 31 to 34, 36 and 37 of the helmet 1 match the head of the prospective helmet wearer, and (c) if needed, changing one type, the plurality of types, or all the types among the six types of cover components 31 to 34, 36 and 37 for other cover components having other thicknesses and/or the like on the basis of the determination described in the above item (b).

In the above item (b), the helmet shop may prepare a plurality of sample helmets having different sizes, and determination may be made as to a sample helmet of which size matches the head of the prospective helmet wearer well. In the above item (c), on the basis of the matching determination, a type such as the thickness of the six types of cover components 31 to 34, 36 and 37 may be determined, and another head backing cover 22 may be assembled on the basis of this determination using the six types of cover components 31 to 34, 36 and 37.

B. Second Embodiment

Figure 16:
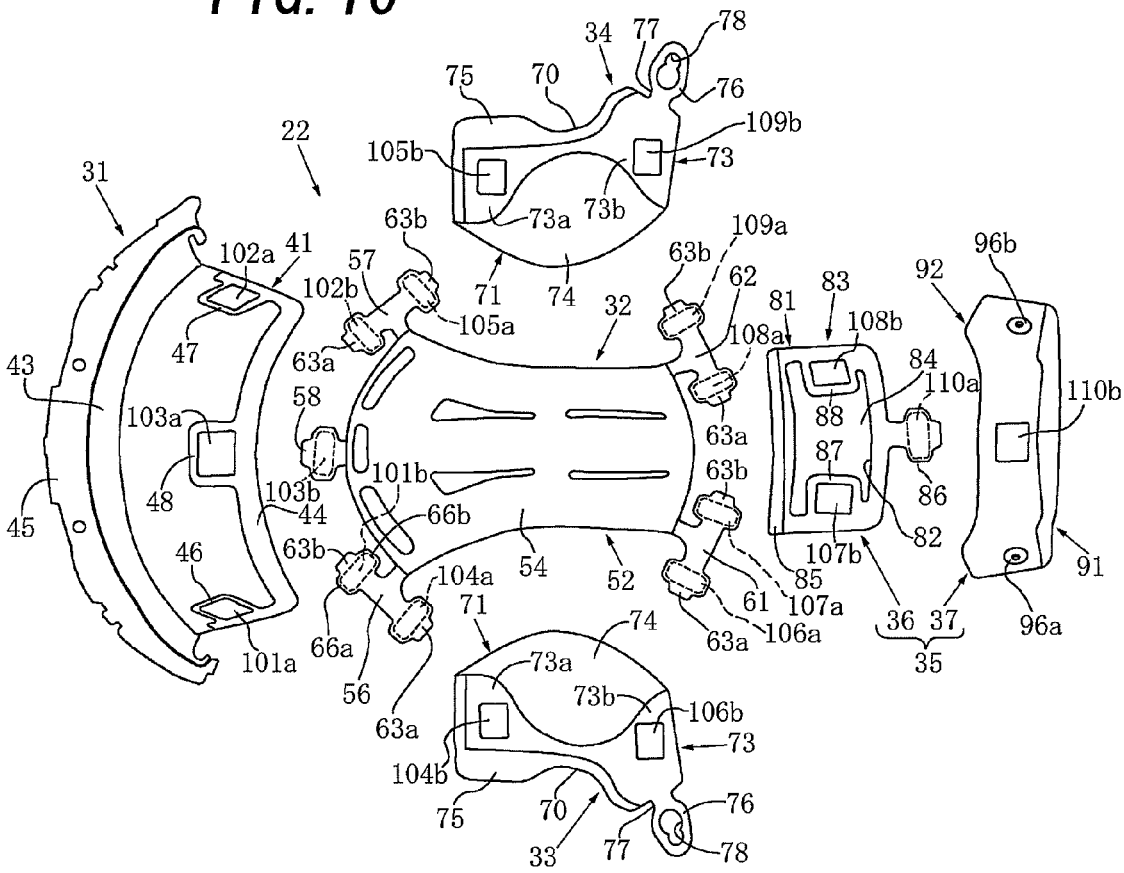
FIG. 16 is a plan view of a state in which a head backing cover of a helmet of the second embodiment, in which the present invention is applied to a full-face-type helmet, is exploded and, as needed, developed.
Figure 17:
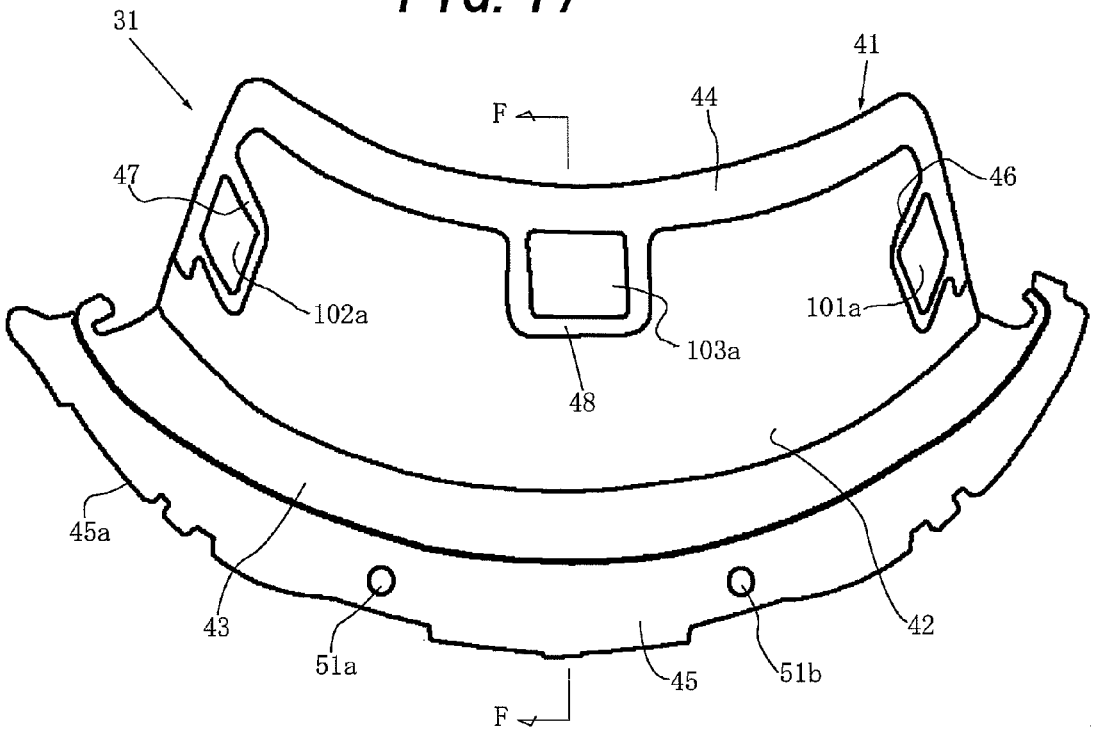
FIG. 17 is a front view of the fore-head part cover component in FIG. 16.
Figure 18:
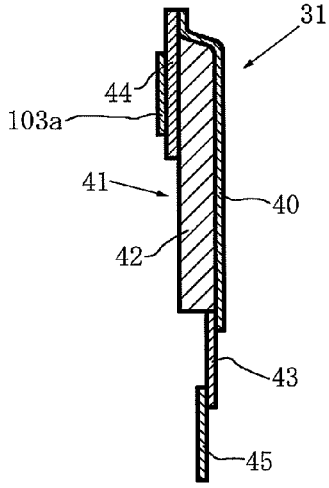
FIG. 18 is a sectional view taken along the line F-F of FIG. 17.
Figure 19:
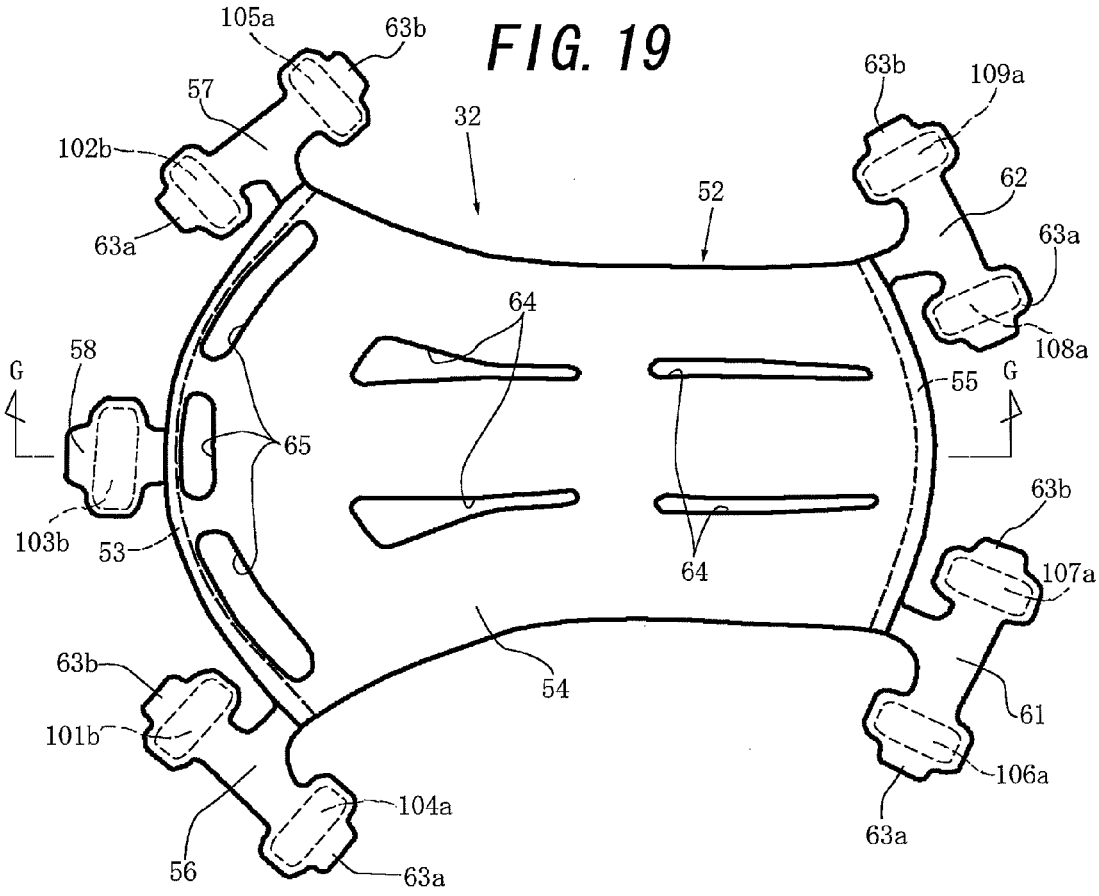
FIG. 19 is a plan view in a developed state of the vertex part cover component in FIG. 16.
Figure 20:
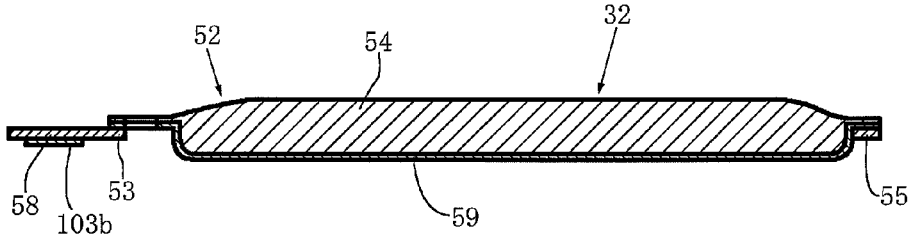
FIG. 20 is a sectional view taken along the line G-G of FIG. 19.

The second embodiment shown in FIGS. 16 to 20 is substantially different from the first embodiment shown in FIGS. 1 to 15 in only seven respects described in the following items (a) to (g):

(a) as shown in FIGS. 16 to 18, first to third plate-like projecting pieces 46 to 48 of a first connecting member 44 of a fore-head part cover component 31 are respectively provided with first to third Hook-and-Loop fastener components (in other words, fastener units or fastener constituent elements) 101*a* to 103*a*, each as one constituent element of the corresponding one of first to third Hook-and-Loop fasteners, in place of the slit-like holes 49*a* and 49*b* of the first embodiment, (b) as shown in FIGS. 16, 19 and 20, first to third plate-like projecting pieces 56 to 58 of a first connecting member 53 of a vertex part cover component 32 are respectively provided with fourth to sixth Hook-and-Loop fastener components 101*b*, 102*b* and 103*b*, each as the other constituent element of the corresponding one of the first to third Hook-and-Loop fasteners, and seventh and eighth Hook-and-Loop fastener components 104*a* and 105*a*, each as one constituent element of the corresponding one of fourth and fifth Hook-and-Loop fasteners, to correspond to the engaging portions 63*a* and 63*b* and the third plate-like projecting piece 58, respectively, of the first embodiment, (c) as shown in FIGS. 16, 19 and 20, fourth and fifth plate-like projecting pieces 61 and 62 of a second connecting member 55 of the vertex part cover components 32 are provided with ninth to 12th Hook-and-Loop fastener components 106*a* to 109*a*, each as one constituent element of the corresponding one of sixth to ninth Hook-and-Loop fasteners, to correspond to the engaging portions 63*a* and 63*b* of the first embodiment, (d) as shown in FIG. 16, front portions 73*a* and rear portions 73*b* of connecting members 73 of left and right temple part cover components 33 and 34 are provided with 13th to 16th Hook-and-Loop fastener components 104*b* to 106*b* and 109*b*, each as the other constituent element of the corresponding one of the fourth to sixth and ninth Hook-and-Loop fasteners, in place of the slit-like holes 79*a* and 79*b* of the first embodiment, (e) as shown in FIG. 16, second and third plate-like projecting pieces 87 and 88 of a connecting member 83 of an upper occiput part cover component 36 are respectively provided with 17th and 18th Hook-and-Loop fastener components 107*b* and 108*b*, each as the other constituent element of the corresponding one of the seventh and eighth Hook-and-Loop fasteners, in place of the slit-like holes 89*a* and 89*b* of the first embodiment, (f) as shown in FIG. 16, a first plate-like projecting piece 86 of the connecting member 83 of the upper occiput part cover component 36 is provided with a 19th Hook-and-Loop fastener component 110*a* as one constituent element of a 10th Hook-and-Loop fastener, and (g) as shown in FIG. 16, a connecting member 92 of a lower occiput part cover component 37 is provided with a 20th Hook-and-Loop fastener component 110*b* as the other constituent element of the 10th Hook-and-Loop fastener, in place of the slit-like holes 95*a* and 95*b* of the first embodiment.

The seven differences described in the above items (a) to (g) will be described hereinafter with reference to FIGS. 16 to 20. In FIGS. 16 to 20, portions that are common to FIGS. 1 to 15 are denoted by the same reference numerals, and a repetitive description will be omitted where appropriate.

In the second embodiment having the above arrangement shown in FIGS. 16 to 20, as one type of connecting means for combining and connecting the cover components 31 to 34, 36 and 37, the first to 10th Hook-and-Loop fastener 101*a* to 110*a* and 101*b* to 110*b* are employed in place of the insertion engaging means of the first embodiment (in other words, a connecting means in which the insertion engaging portion is formed in one cover component and a slit-like hole to receive and engage with the insertion engaging portion is formed in the other cover component). Also, as another type of connecting means, recess-projection engaging means 78, 96*a* and 96*b* using potbelly holes are employed in the same manner as in the first embodiment. Such a Hook-and-Loop fastener is generally called Magic Tape (Tradename), Velcro (Tradename), or the like. In such a Hook-and-Loop fastener, usually, a Hook-and-Loop fastener component formed on one cover component has a large number of loop-like hooks, and the other Hook-and-Loop fastener component formed on the other cover component has a large number of non-loop-like hooks (in other words, hooks in which each loop-like hook has one disconnected portion) so as to correspond to the Hook-and-Loop fastener component having the loop-like hooks. In the second embodiment, it suffices as far as either one of the pair of Hook-and-Loop fastener components constituting each one of the first to 10th Hook-and-Loop fasteners has loop-like hooks and the remaining one has non-loop-like hooks.

The second embodiment of the present invention having the above arrangement can also provide substantially the same effect as that of the first embodiment.

C. Third Embodiment

Figure 21:
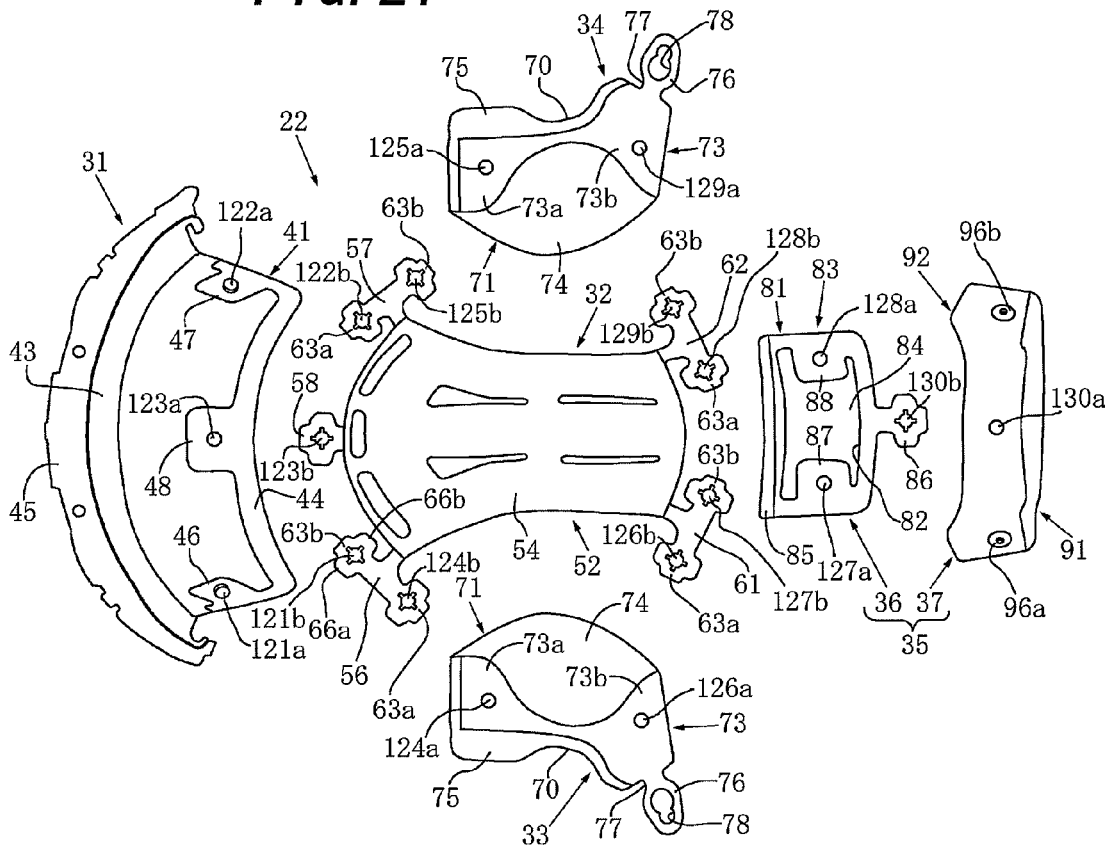
FIG. 21 is a plan view of a state in which a head backing cover in a helmet of the third embodiment, in which the present invention is applied to a full-face-type helmet, is exploded and, as needed, developed.
Figure 22:
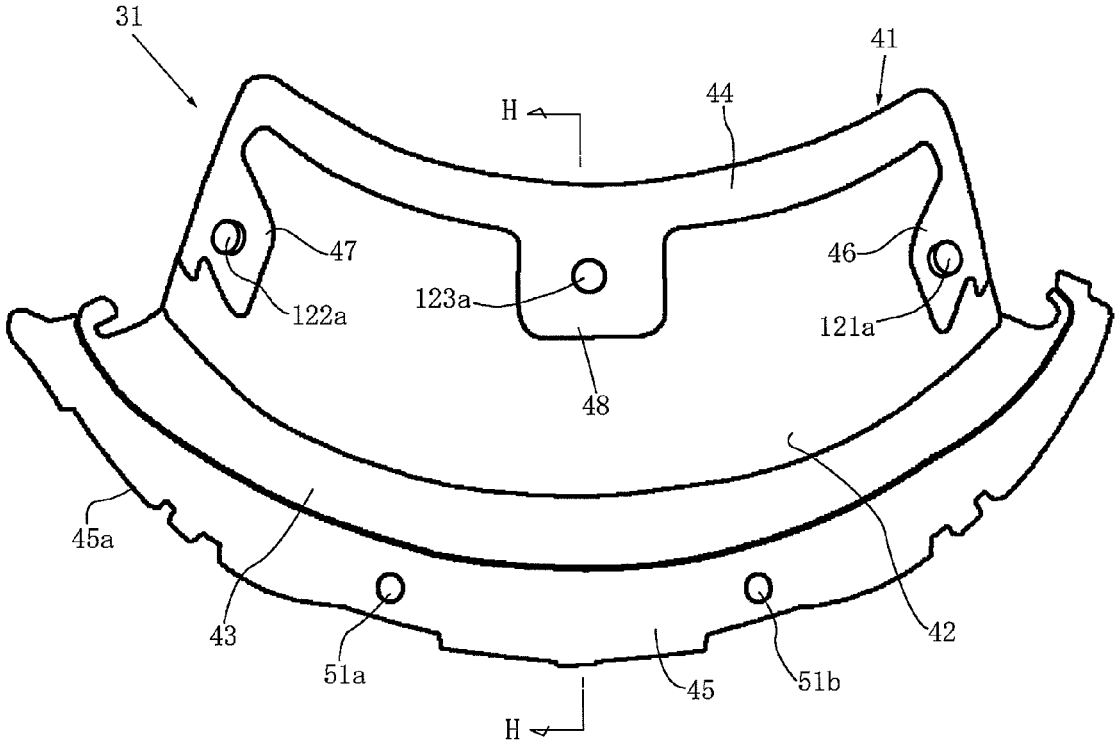
FIG. 22 is a front view of the fore-head part cover component in FIG. 21.
Figure 23:
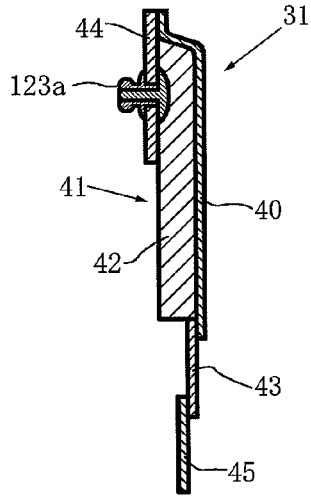
FIG. 23 is a sectional view taken along the line H-H of FIG. 22.
Figure 24:
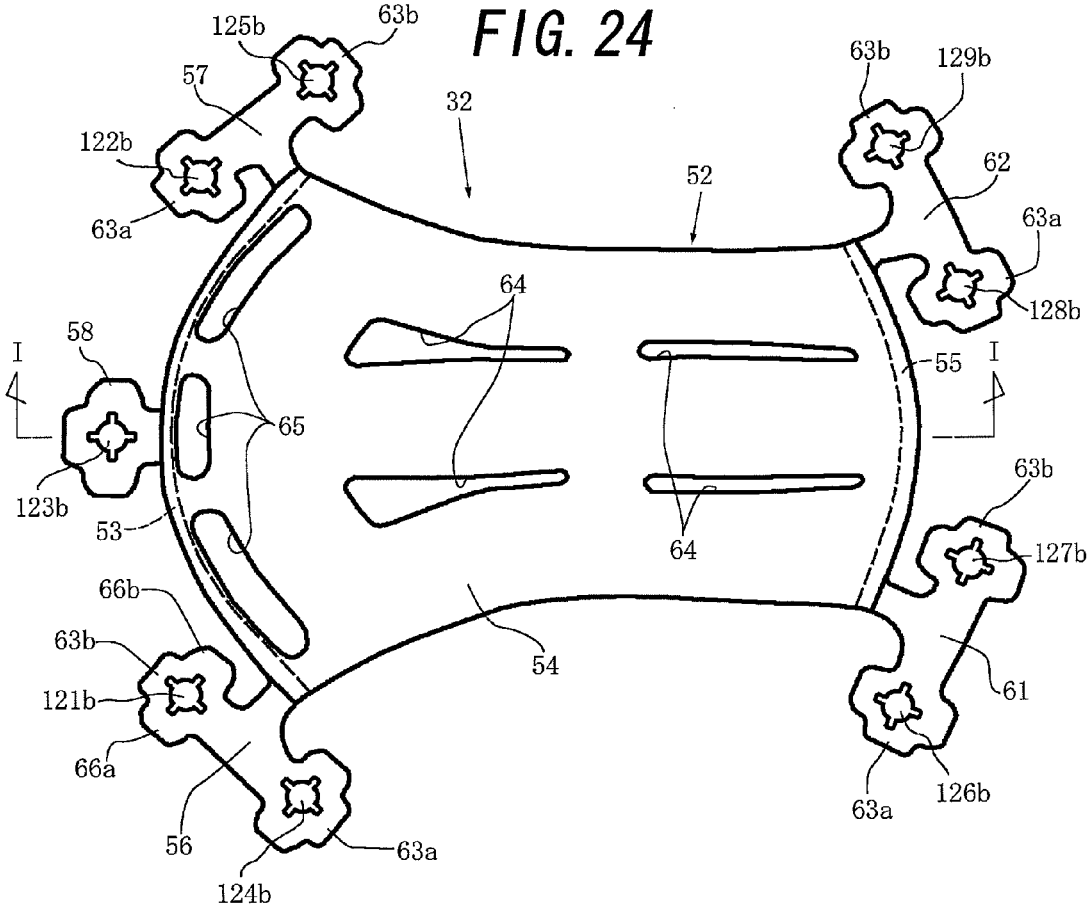
FIG. 24 is a plan view in a developed state of the vertex part cover component in FIG. 21.
Figure 25:
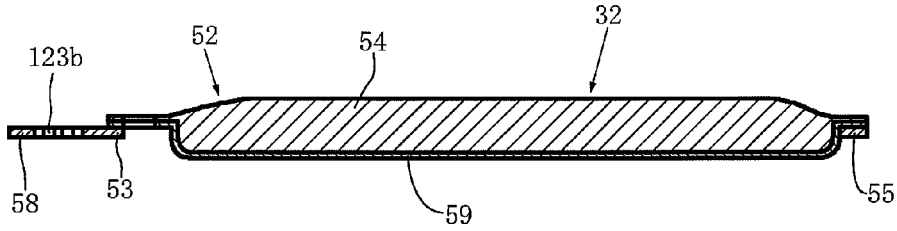
FIG. 25 is a sectional view taken along the line I-I of FIG. 24.

The third embodiment shown in FIGS. 21 to 25 is different from the second embodiment shown in FIGS. 16 to 20 only in that the first to 10th Hook-and-Loop fastener 101*a* to 110*a*, and 101*b* to 110*b* of the second embodiment are replaced by hooks such as round hooks in the third embodiment. More specifically, the third embodiment is different from the second embodiment in only seven respects described in the following items (a) to (g):

(a) as shown in FIGS. 21 to 23, first to third plate-like projecting pieces 46 to 48 of a first connecting member 44 of a fore-head part cover component 31 are respectively provided with first to third male hooks 121*a*, 122*a* and 123*a*, each as one constituent element of the corresponding one of first to third Hook-and-Loop hooks, in place of the Hook-and-Loop fastener components 101*a* to 103*a* of the second embodiment, (b) as shown in FIGS. 21, 24 and 25, first to third plate-like projecting pieces 56 to 58 of a first connecting member 53 of a vertex part cover component 32 are respectively provided with first to third female hooks (in other words, engaging holes) 121*b*, 122*b* and 123*b*, each as the other constituent element of the corresponding one of the first to third hooks, and fourth and fifth female hooks 124*b* and 125*b*, each as one constituent element of the corresponding one of the fourth and fifth hooks, in place of the Hook-and-Loop fastener components 101*b* to 103*b*, 104*a* and 105*a*, respectively, of the second embodiment, (c) as shown in FIGS. 21, 24 and 25, fourth and fifth plate-like projecting pieces 61 and 62 of a second connecting member 55 of the vertex part cover component 32 are provided with sixth to ninth female hooks 126*b* to 129*b*, each as one constituent element of the corresponding one of sixth to ninth hooks, in place of the Hook-and-Loop fastener components 106*a* to 109*a*, respectively, of the second embodiment, (d) as shown in FIG. 21, front portions 73*a* and rear portions 73*b* of connecting members 73 of left and right temple part cover components 33 and 34 are provided with fourth to sixth and ninth male hooks 124*a* to 126*a* and 129*a*, each as the other constituent element of the corresponding one of the fourth to sixth and ninth hooks, in place of the Hook-and-Loop fastener components 104*b* to 106*b* and 109*b* of the second embodiment, (e) as shown in FIG. 21, second and third plate-like projecting pieces 87 and 88 of a connecting member 83 of an upper occiput part cover component 36 are respectively provided with seventh and eighth male hooks 127*a* and 127*a*, each as the other constituent element of the corresponding one of the seventh and eighth hooks, in place of the Hook-and-Loop fastener components 107*b* and 107*b* of the second embodiment, (f) as shown in FIG. 21, a first plate-like projecting piece 86 of the connecting member 83 of the upper occiput part cover component 36 is provided with a 10th female hook 130*b* as one constituent element of a 10th hook, in place of the Hook-and-Loop fastener component 110*a* of the second embodiment, and (g) as shown in FIG. 21, a connecting member 92 of a lower occiput part cover component 37 is provided with a 10th male hook 130*a* as the other constituent element of the 10th hook, in place of the Hook-and-Loop fastener component 110*b* of the second embodiment.

The differences described in the above items (a) to (g) will be described hereinafter with reference to FIGS. 21 to 25. In FIGS. 21 to 25, portions that are common to FIGS. 1 to 20 are denoted by the same reference numerals, and a repetitive description will be omitted where appropriate.

In the third embodiment having the above arrangement shown in FIGS. 21 to 25, as one type of connecting means for combining and connecting the cover components 31 to 34, 36 and 37, the first to 10th hooks 121*a* to 130*a* and 121*b* to 130*b* are employed in place of the insertion engaging means of the first embodiment and the Hook-and-Loop fasteners of the second embodiment. Also, as another type of connecting means, recess-projection engaging means 78, 96*a* and 96*b* using potbelly holes are employed in the same manner as in the first and second embodiments. In the third embodiment, it suffices as far as either one of the pair of hook components (in other words, the male hooks 121*a* to 130*a* and female hooks 121*b* to 130*b*) constituting each one of the first to 10th hooks is a male hook and the remaining one is a female hook.

The third embodiment of the present invention having the above arrangement can also provide substantially the same effect as that of the first and second embodiments.

Having described specific preferred embodiments of the present invention with reference to the accompanying drawings, it is to be understood that the invention is not limited to those precise embodiments, and that various changes and modifications may be effected therein by one skilled in the art without departing from the scope or spirit of the invention as defined in the appended claims.

For example, each of the first to third embodiments described above is provided with the hooks 96*a* and 96*b* such as round hooks, the insertion engaging means 45 and recess-projection engaging means 51*a* and 51*b*, as attaching means for attaching the head backing cover 22 to the inner surface of the impact-on-the-head absorbing liner 21, as described in the above items (j) and (k) of the above item A3. As the attaching means, not only the hooks 96*a* and 96*b* such as round hooks, the insertion engaging means 45 and recess-projection engaging means 51*a* and 51*b*, but also the Hook-and-Loop fasteners as used in the second embodiment can be employed, and an arbitrary one or a plurality of arbitrary types of such engaging means can be employed. The male hooks 96*a* and 96*b* of the round hooks need not be provided to the cover component side. The female hooks may be provided to the cover component side, and the male hooks may be provided to the impact-on-the-head absorbing liner 21 side.

In the first to third embodiments, each cover main body portion of the cover component comprises one elastic layer and substantially one cloth portion stacked on substantially one surface of the elastic layer. Alternatively, the cloth portion may form a bag that covers the elastic layer substantially entirely. The elastic layer need not comprise one elastic layer, but may comprise two or more elastic layers that are stacked on each other, as needed.

In the first to third embodiments, the head backing cover 22 comprises the six types of cover components 31 to 34, 36 and 37. Alternatively, the head backing cover 22 may comprise a plurality of types of cover components other than six types. For example, a single occiput part cover component 35 formed by integrally uniting the upper occiput part cover component 36 and lower occiput part cover component 37 non-separably may be used.

In the first to third embodiments, the upper occiput part cover component 36 and lower occiput part cover component 37 that form the composite-type occiput part cover component 35 are directly connected to each other by the first plate-like projecting piece 86 of the connecting member 83 and the slit-like holes 95*a* and 95*b* of the connecting member 92. However, the upper occiput part cover component 36 need not be directly connected to the lower occiput part cover component 37. For example, a connecting mechanism comprising the first plate-like projecting piece 86 and slit-like holes 95*a* and 95*b* can be omitted. In this case, for example, in the first embodiment, the upper occiput part cover component 36 and lower occiput part cover component 37 may be indirectly connected to each other by the engaging portions 63*a* and 63*b* of the fourth and fifth projecting pieces 61 and 62, respectively, of the vertex part cover component 32, and the slit-like holes 79*a* and 79*b* of the rear portions 73*b* and the potbelly holes 78 of the engaging portions 76 of the left and right temple part cover components 33 and 34 through the vertex part cover components 32 and left and right temple part cover components 33 and 34. The left and right temple part cover components 33 and 34, and the upper occiput part cover component 36 may be respectively provided with connecting mechanisms for connecting the left and right temple part cover components 33 and 34 to the upper occiput part cover component 36 directly, so the upper occiput part cover component 36 is indirectly connected to the vertex part cover component 32 through the left and right temple part cover components 33 and 34.

In the first to third embodiments, the present invention is applied to a full-face-type helmet. Alternatively, the present invention can also be applied to another type of helmet such as a jet-type helmet or a semi-jet-type helmet.

In the first embodiment, the target insertion engaging portion as one constituent element of the insertion engaging means comprises a pair of slit-like holes extending substantially parallel to each other. However, the pair of slit-hole holes need not extend substantially parallel to each other, but may extend to be inclined from the parallel extension state by appropriate angles.

We claim:

1. A method of adjusting a size of a helmet comprising a cap-like outer shell, a cap-like impact-on-the-head absorbing liner disposed inside said cap-like outer shell and attached to said cap-like outer shell, and a cap-like head backing cover disposed inside said cap-like impact-on-the-head absorbing liner and attached to said cap-like impact-on-the-head absorbing liner, the cap-like head backing cover comprising a plurality of types of cover components, each cover component respectively comprising a cover main body portion and connecting means, the method of adjusting the size comprising:

forming the plurality of types of cover components respectively, each comprising the cover main body portion and connecting means, wherein the connecting means is capable of connecting the cover main body portion of one of the cover components to the cover main body portion of another at least one of the cover components, connecting and combining the plurality of types of cover main body portions to and with each other by the connecting means, to obtain the cap-like head backing cover which comprises the plurality of types of cover components, disconnecting and separating the cover main body portions, connected to each other by the connecting means, from each other, to separate the cap-like head backing cover into the plurality of types of cover components that are independent of each other, preparing at least one type of another cover component having at least different thickness for at least one type of cover component among the plurality of types of cover components, and exchanging at least one type of cover component among the plurality of types of cover components for another cover component, so that a head accommodating space of the helmet has a different size at least at one portion.

2. A method according to claim 1, wherein the plurality of types of cover components comprises at least three types of cover components.

3. A method according to claim 2, further including preparing at least one type of another cover component having at least different thickness for at least two types of cover components among the at least three types of cover components.

4. A method according to claim 1, wherein the plurality of types of cover components comprise at least five types of cover components.

5. A method according to claim 4, further including preparing at least one type of another cover component having at least different thickness for at least three types of cover components among the at least five types of cover components.

6. A method according to claim 1, further including forming a first cover component among the plurality of types of cover components to be located at substantially at least a partial region of a region comprising a fore-head region and an occiput region of the head backing cover.

7. A method according to claim 6, further including forming the region including the at least partial region of the region comprising the fore-head region and the occiput region substantially to comprise one of the fore-head region and the occiput region.

8. A method according to claim 1, further including forming a second cover component among the plurality of types of cover components to be located at substantially at least a partial region of a region comprising a left temple region and a right temple region of the head backing cover.

9. A method according to claim 8, further including forming the region including the at least partial region of the region comprising the left temple region and the right temple region to comprise one of the left temple region and the right temple region.

10. A method according to claim 1, further including forming a third cover component among the plurality of types of cover components to be located at substantially at least a partial region of a vertex region of the head backing cover.

11. A method according to claim 10, further including forming the region including the at least partial region of the vertex region substantially to comprise the vertex region.

12. A method according to claim 11, further including forming the head backing cover to comprise a fore-head part cover component, a vertex part cover component, a left temple part cover component, a right temple part cover component and an occiput part cover component respectively located substantially at a fore-head region, a vertex region, a left temple region, a right temple region and an occiput region of the head backing cover.

13. A method according to claim 1, further including forming the plurality of types of cover components to include an upper occiput part cover component and a lower occiput part cover component located substantially at an upper portion and a lower portion, respectively, of an occiput region of the head backing cover.

14. A method according to claim 13, further including forming the upper occiput part cover component and the lower occiput part cover component to constitute a composite-type occiput part cover component located substantially at an occiput region.

15. A method according to claim 1, further including forming the connecting means provided to the plurality of types of cover components to include a slit-like hole provided on one cover component and an insertion engaging portion provided on the other cover component which is to be connected to the one cover component, and the insertion engaging portion being formed to be removably inserted in the slit-like opening.

16. A method according to claim 15, further including forming the slit-like opening to comprise a pair of slit-like openings which substantially oppose each other, and forming the insertion engaging portion to comprise a pair of inserting portions substantially corresponding to the pair of slit-like openings, respectively.

17. A method according to claim 1, further including forming the connecting means provided on the plurality of types of cover components to include a first hook and loop fastener component provided to one cover component and a second hook and loop fastener component provided to the other cover component which is to be connected to the one cover component, and the first hook and loop fastener component and the second hook and loop fastener component being formed to be detachably connected to each other.

18. A method according to claim 1, further including forming the connecting means provided to the plurality of types of cover components to include a male hook provided to one cover component and a female hook provided to the other cover component which is to be connected to the one cover component, and the male hook being formed to be detachably fitted with the female hook.

19. A method according to claim 1, further including forming a cover main body portion of at least one type of cover component among the plurality of cover components to include an elastic layer made of a foamed synthetic resin.

20. A method according to claim 2, further including forming each one of cover main body portions of at least two types of cover components among the at least three types of cover components to include an elastic layer made of a foamed synthetic resin.

21. A method according to claim 4, further including forming each one of cover main body portions of at least three types of cover components among the at least five types of cover components to include an elastic layer made of a foamed synthetic resin.

22. A method according to claim 1, further including forming each one of cover main body portions of the plurality of cover components to include an elastic layer made of a foamed synthetic resin.

* * * * *